US011550235B2

(12) United States Patent
Sugawara et al.

(10) Patent No.: US 11,550,235 B2
(45) **Date of Patent: *Jan. 10, 2023**

(54) ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Atsushi Sugawara, Kanagawa (JP); Yosuke Tsurumi, Kanagawa (JP); Yasuko Torii, Kanagawa (JP); Yoshimasa Fujihara, Kanagawa (JP); Moegi Iguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/943,389

(22) Filed: Jul. 30, 2020

(65) Prior Publication Data

US 2021/0294227 A1 Sep. 23, 2021

(30) Foreign Application Priority Data

Mar. 19, 2020 (JP) ..... JP2020-050050

(51) Int. Cl.

| | |
|---|---|
| ***G03G 9/093*** | (2006.01) |
| ***G03G 9/08*** | (2006.01) |
| ***G03G 9/087*** | (2006.01) |
| ***G03G 15/08*** | (2006.01) |

(52) U.S. Cl.

CPC ..... *G03G 9/0825* (2013.01); *G03G 9/0815* (2013.01); *G03G 9/08708* (2013.01); *G03G 9/08755* (2013.01); *G03G 9/09328* (2013.01); *G03G 9/09342* (2013.01); *G03G 15/0865* (2013.01)

(58) Field of Classification Search

CPC ..... G03G 9/09775; G03G 9/09725; G03G 9/0825

USPC ..... 430/108.1, 108.7

See application file for complete search history.

(56) References Cited

U.S. PATENT DOCUMENTS

| | | | | |
|---|---|---|---|---|
| 5,798,199 | A * | 8/1998 | Bilbrey | G03G 9/09708 430/108.22 |
| 10,241,432 | B2 | 3/2019 | Obara et al. | |
| 2005/0136350 | A1 * | 6/2005 | Marcello | G03G 9/0804 516/77 |

(Continued)

FOREIGN PATENT DOCUMENTS

| | | | |
|---|---|---|---|
| JP | 2010-117617 | A | 5/2010 |
| JP | 2013-235046 | A | 11/2013 |
| JP | 2018-072694 | A | 5/2018 |

*Primary Examiner* — Peter L Vajda

(74) *Attorney, Agent, or Firm* — Sughrue Mion, PLLC

(57) ABSTRACT

An electrostatic image developing toner includes toner particles, an external additive A, and an external additive B. At least the external additive A is deposited on the surfaces of the toner particles. At least the external additive B is deposited on the external additive A. The external additive B includes an aggregate of two or more particles. The coverage of the toner particles with the external additive B is 3% by area or more with respect to the total surface area of the toner particles.

17 Claims, 2 Drawing Sheets

(56) References Cited

U.S. PATENT DOCUMENTS

| | | | | |
|---|---|---|---|---|
| 2010/0124433 | A1 | 5/2010 | Matsuura | |
| 2010/0196817 | A1* | 8/2010 | Sasaki | G03G 15/08 525/437 |
| 2011/0229812 | A1* | 9/2011 | Takahashi | G03G 9/08711 430/105 |
| 2011/0244382 | A1* | 10/2011 | Christopher | G03G 9/09725 430/105 |
| 2012/0156602 | A1* | 6/2012 | Yamazaki | G03G 9/1075 430/105 |
| 2017/0227876 | A1* | 8/2017 | Morooka | G03G 9/1075 |

* cited by examiner

ELECTROSTATIC IMAGE DEVELOPING TONER, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-050050 filed Mar. 19, 2020.

BACKGROUND

(i) Technical Field

The present disclosure relates to an electrostatic image developing toner, an electrostatic image developer, a toner cartridge, a process cartridge, an image forming apparatus, and an image forming method.

(ii) Related Art

Methods in which image information is converted into an electrostatic image and then visualized, such as electrophotography, have been used in a variety of fields.

In electrophotography, commonly, image information is visualized by the following steps: forming an electrostatic latent image on a photosensitive member or an electrostatic recording medium with an appropriate unit; developing the electrostatic latent image by depositing charge detecting particles, which are referred to as "toner particles", to the electrostatic latent image to form a toner image; transferring the toner image onto the surface of the body to which the image is to be transferred; and fixing the toner image by heating or the like.

Examples of known developers and toners include those described in Japanese Laid Open Patent Application Publication Nos. 2010-117617 and 2018-72694.

Japanese Laid Open Patent Application Publication No. 2010-117617 discloses a developer that includes a toner including at least a resin and a colorant. The toner includes an external additive such that the amount of the external additive is 1.5 to 3.0 parts by mass relative to 100 parts by mass of the toner particles. The toner particles have a volume average size of 6.5 to 8.0 μm. The surface roughness Rzjis of the toner particles measured with a scanning probe microscope is 75.3 to 236.9 nm.

Japanese Laid Open Patent Application Publication No. 2018-72694 discloses an electrostatic image developing toner that includes toner base particles including an external additive deposited on the surfaces of the toner base particles. The external additive includes at least silica particles A and silica particles B. The silica particles A have a number average primary particle size of 40 to 100 nm and an average circularity of 0.50 to 0.90. The surfaces of the silica particles A are modified with a silicone oil. The silica particles B have a number average primary particle size of 25 nm or more, that is, a smaller number average primary particle size than the silica particles A. The surfaces of the silica particles B are modified with an alkylalkoxysilane having the structure represented by General Formula (1) below or with a silazane.

$$R_1—Si(OR_2)_3 \quad (1)$$

where $R_1$ represents a linear alkyl group that has 1 to 10 carbon atoms and may have a substituent; and $R_2$ represents a methyl group or an ethyl group.

SUMMARY

Aspects of non-limiting embodiments of the present disclosure relate to an electrostatic image developing toner capable of reducing inconsistencies in the gloss of an image formed using the electrostatic image developing toner compared with the case where the coverage of the toner particles with the external additive B is less than 3% by area with respect to the total surface area of the toner particles.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic image developing toner including toner particles, an external additive A, and an external additive B. At least the external additive A is deposited on surfaces of the toner particles. At least the external additive B is deposited on the external additive A. The external additive B includes an aggregate of two or more particles. A coverage of the toner particles with the external additive B is 3% by area or more with respect to a total surface area of the toner particles.

BRIEF DESCRIPTION OF THE DRAWINGS

Exemplary embodiments of the present disclosure will be described in detail based on the following figures, wherein.

DETAILED DESCRIPTION

Figure 1:
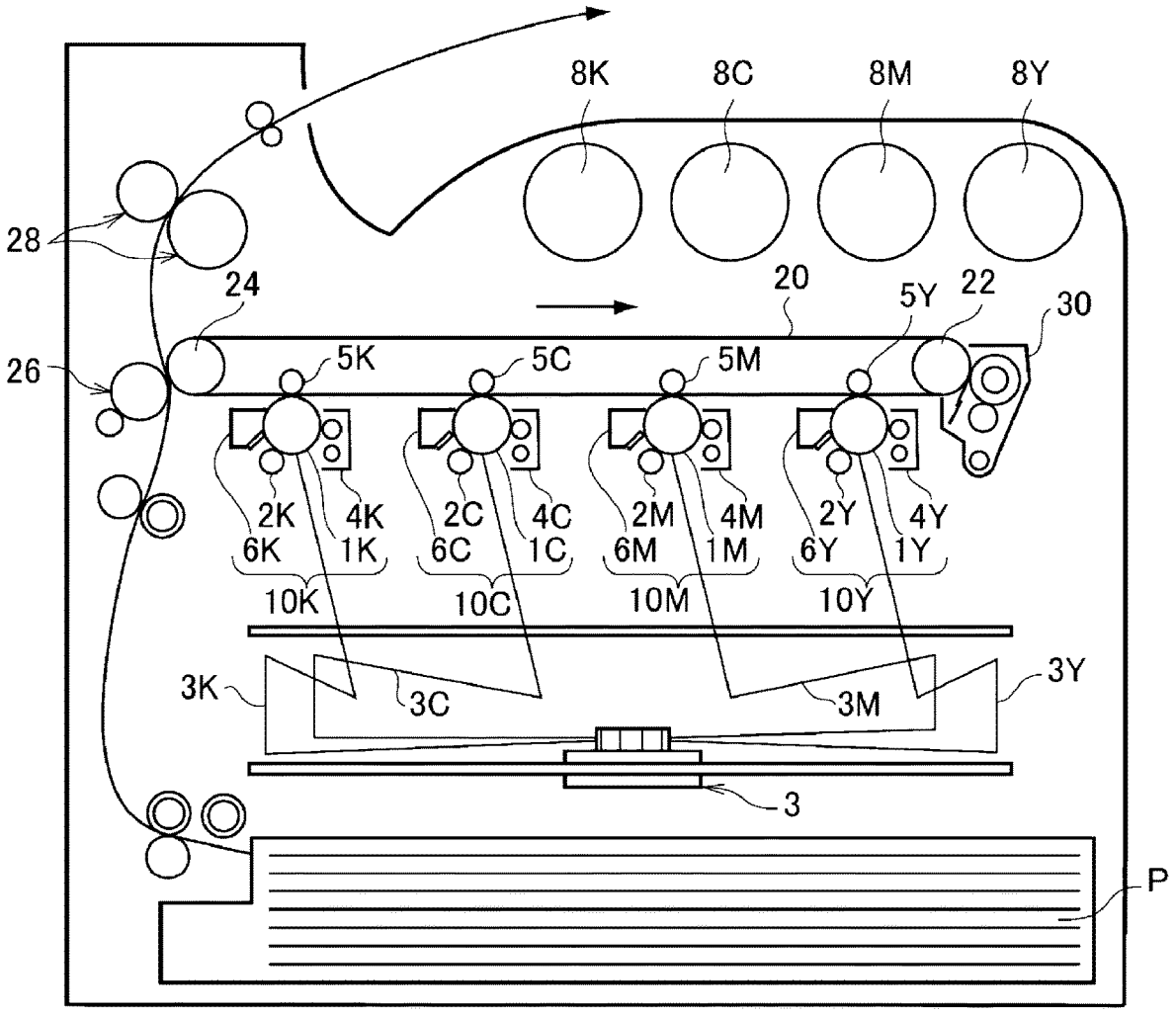
FIG. 1 is a schematic diagram illustrating an image forming apparatus according to an exemplary embodiment.

Hereinafter, in the case where a composition includes plural substances that correspond to a component of the composition, the content of the component in the composition is the total content of the plural substances in the composition unless otherwise specified.

Hereinafter, an electrostatic image developing toner may be referred to simply as "toner", and an electrostatic image developer may be referred to simply as "developer".

An exemplary embodiment of the present disclosure is described below.

Electrostatic Image Developing Toner

An electrostatic image developing toner according to the exemplary embodiment includes toner particles, an external additive A, and an external additive B. At least the external additive A is deposited on the surfaces of the toner particles. At least the external additive B is deposited on the external additive A. The external additive B includes an aggregate of two or more particles. The coverage of the toner particles with the external additive B is 3% by area or more with respect to the total surface area of the toner particles.

The toners known in the related art include an external additive to form irregularities on the surfaces of the toner particles. It is considered that the irregularities formed on the surfaces of the toner particles improve transferability. The inventors of the present disclosure found that it is difficult to reduce the total resistance of the entire toner only by forming the irregularities on the surfaces of the toner particles and consequently, inconsistencies in gloss may occur when a large load is placed on the toner inside the developing unit.

The above-described electrostatic image developing toner according to the exemplary embodiment may reduce inconsistencies in the gloss of an image formed using the electrostatic image developing toner. In particular, the electrostatic image developing toner according to the exemplary embodiment may reduce inconsistencies in the gloss of a solid image formed on a plain paper sheet that has been stored at 28° C. and a humidity of 85% RH. The reasons for this are not clear but presumably as follows.

Since at least the external additive A is deposited on the surfaces of the toner particles and at least the external additive B is deposited on the external additive A, that is, two types of the external additives are deposited on the surfaces of the toner particles in two stages, a certain distance is kept between the external additive B, which constitutes the outermost shells of the toner particles, and the toner particles. The external additive B arranged at a certain distance from the toner particles reduces the area of a portion of the surfaces of the toner particles which contacts with the image holding member or the transfer unit. This reduces the adhesion of the toner particles and improves the transferability of the toner particles. Furthermore, since two types of the external additives are deposited on the surfaces of the toner particles in two stages, the external additive B, which constitutes the outermost shells of the toner particles, increases the resistance of the toner particles. This enables the production of an electrostatic image developing toner capable of reducing inconsistencies in the gloss of an image formed using the electrostatic image developing toner without degrading transferability.

The inconsistencies in gloss may be increased particularly in the formation of metallic color images, in which, for example, yellow, magenta, and cyan toners are multiple-transferred on a silver toner. It is considered that, since the electrostatic image developing toner according to the exemplary embodiment has excellent transferability, it reduces the inconsistencies in gloss even in the formation of a multiple-transferred image such as a metallic color image formed on a plain paper sheet that has been stored at 28° C. and a humidity of 85% RH.

The electrostatic image developing toner according to the exemplary embodiment is described in detail below.

External Additives

The toner according to the exemplary embodiment includes toner particles (referred to also as "toner base particles") and external additives.

The toner according to the exemplary embodiment includes, as external additives, external additives A and B.

External Additive A

The electrostatic image developing toner according to the exemplary embodiment includes the toner particles and the external additives A and B. At least the external additive A is deposited on the surfaces of the toner particles.

The external additive A may be inorganic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Among these, silica particles are preferable.

The external additive A is preferably wet-process silica particles and is more preferably sol gel silica particles. Since sol gel silica particles contain an adequate amount of water, toner particles on which the sol gel silica particles are deposited may be readily become charged to an intended degree when stirred in a developing device.

The content of water in the sol gel silica particles can be determined on the basis of a reduction in the mass of the sol gel silica particles which occurs when the sol gel silica particles are heated. A reduction in the mass of the sol gel silica particles which occurs when the sol gel silica particles are heated from 30° C. to 250° C. at a rate of 30° C./min may be 1% by mass or more and 10% by mass or less.

When the above mass reduction is 1% by mass or more, the flow of the sol gel silica particles on the surfaces of the toner particles is limited and the sol gel silica particles keep being dispersed with high uniformity on the surfaces of the toner particles. This enables the toner to readily become charged to an intended degree when stirred in a developing device. In this regard, the mass reduction is more preferably 2% by mass or more and is further preferably 3% by mass or more.

When the above mass reduction is 10% by mass or less, leakage of electric charge through the sol gel silica particles is limited. This enables the toner to readily become charged to an intended degree when stirred in a developing device. In this regard, the mass reduction is more preferably 9% by mass or less and is further preferably 8% by mass or less.

In the exemplary embodiment, the reduction in the mass of the sol gel silica particles which occurs when the sol gel silica particles are heated is determined by the following measuring method.

About 30 mg of the sol gel silica particles are charged into a sample chamber of a thermogravimetric analyzer "DTG-60AH" produced by Shimadzu Corporation. The temperature is increased from 30° C. to 250° C. at a rate of 30° C./min. The mass reduction is calculated from the difference between the mass of the heated sample and the initial mass of the sample.

The sample subjected to the thermogravimetric analyzer is sol gel silica particles that are to be used as a material for the toner or sol gel silica particles separated from the toner. The method for separating the sol gel silica particles from the toner is not limited. For example, the toner is dispersed in water containing a surfactant. To the resulting dispersion liquid, an ultrasonic wave is applied. Subsequently, the dispersion liquid is subjected to high-speed centrifugation. The resulting supernatant liquid is dried at normal temperature (23° C.±2° C.) to form sol gel silica particles.

In the case where sol gel silica particles that have been subjected to a hydrophobic treatment are used as an external additive, the above measurement is conducted using the hydrophobized sol gel silica particles as a sample.

The sol gel silica particles may be produced by, for example, the following method.

Tetraalkoxysilane is added dropwise to an alkali catalyst solution containing an alcohol compound and ammonia water in order to cause hydrolysis and condensation of tetraalkoxysilane. Hereby, a suspension containing sol gel silica particles is formed. Subsequently, the solvent is removed from the suspension to obtain a particulate substance. The particulate substance is dried to form sol gel silica particles. The average primary particle size of the sol gel silica particles can be controlled by adjusting the ratio of the amount of the tetraalkoxysilane added dropwise to the alkali catalyst solution to the amount of the alkali catalyst solution used. The content of water in the sol gel silica particles, that is, the reduction in the mass of the sol gel silica particles which occurs when the sol gel silica particles are heated from 30° C. to 250° C. at a rate of 30° C./min, can be controlled by adjusting the conditions under which the particulate substance is dried.

The average circularity of the external additive A is preferably 0.85 or more, is more preferably 0.90 or more, is further preferably 0.95 or more, and is particularly preferably 0.95 or more and 0.995 or less in order to reduce the inconsistencies in gloss.

The method for controlling the average circularity of the external additive A to fall within the above range is not limited. The average circularity of the external additive A may be controlled by, for example, adjusting the temperature at which the alkali catalyst and tetraalkoxysilane are mixed in the production of the sol gel silica particles or the amount of time during which the reaction is conducted. Alternatively, the concentration of the alkali catalyst may be adjusted.

In the exemplary embodiment, the shape factors SF1 of the external additives A and B are determined in the following manner.

An image of the toner is taken with a scanning electron microscope (SEM) "S-4700" produced by Hitachi, Ltd. and captured into an image processor "LUZEXIII" produced by NIRECO CORPORATION. The maximum length and projection area of each of 100 particles of the external additive A and 100 particles of the external additive B are measured. The shape factor SF1 of each particle is calculated using Formula (1) below, and the average thereof is calculated.

$$\text{Shape factor } SF1=(ML^2/A)\times(\pi/4)\times 100 \quad (1)$$

where ML represents the absolute maximum length of a particle of an external additive on the image; and A represents the projection area of the particle of an external additive.

The number average particle size of the external additive A is preferably 20 nm or more and 140 nm or less.

When the number average particle size of the external additive A is 20 nm or more, the likelihood of the external additive A being buried in the toner particles is low. In this regard, the number average particle size of the external additive A is more preferably 25 nm or more and is further preferably 30 nm or more.

When the number average particle size of the external additive A is 140 nm or less, the likelihood of the external additive A remaining on the surfaces of the toner particles is high. In this regard, the number average particle size of the external additive A is more preferably 100 nm or less and is further preferably 90 nm or less.

In the exemplary embodiment, the number average particle size of an external additive is the diameter of a circle having the same area as the particle image (i.e., equivalent circle diameter) and is determined by taking an electron microscope image of the toner on which the external additive is deposited and analyzing at least 300 external additive particles deposited on the toner on the basis of the image. The number average particle size of the external additive is the particle size at which the cumulative number reaches 50% in a number particle size distribution drawn in ascending order in terms of particle size.

The external additive A may be hydrophobic particles that have been subjected to a hydrophobic surface treatment. The hydrophobizing agent used in the hydrophobic surface treatment may be, but is not limited to, a silicon-containing organic compound. Examples of the silicon-containing organic compound include an alkoxysilane compound, a silazane compound, and a silicone oil. The above silicon-containing organic compounds may be used alone or in combination of two or more.

The hydrophobizing agent used for treating the external additive A is preferably a silazane compound, such as dimethyldisilazane, trimethyldisilazane, tetramethyldisilazane, pentamethyldisilazane, or hexamethyldisilazane, and is particularly preferably 1,1,1,3,3,3-hexamethyldisilazane (HMDS).

The amount of the hydrophobizing agent may be 1 part by mass or more and 10 parts by mass or less relative to 100 parts by mass of the external additive A.

Even in the case where the external additive A is the hydrophobic particles that have been subjected to a hydrophobic surface treatment, the reduction in the mass of the external additive A which occurs when the external additive A is heated may fall within the above-described range, and the number average particle size of the external additive A may fall within the above-described range.

In the exemplary embodiment, it is preferable that the external additive A include a siloxane compound having a molecular weight of 200 or more and 600 or less and it is more preferable that the siloxane compound having a molecular weight of 200 or more and 600 or less be deposited on a part or the entirety of the surface of the external additive A in order to reduce the inconsistencies in gloss.

In the case where the inorganic particles are hydrophobic inorganic particles that have been subjected to a hydrophobic surface treatment, the siloxane compound having a molecular weight of 200 or more and 600 or less may be deposited on the hydrophobized surfaces of the inorganic particles.

The content of the external additive A in the toner particles is preferably 0.01% by mass or more and 10% by mass or less, is more preferably 0.05% by mass or more and 5% by mass or less, and is further preferably 0.1% by mass or more and 1% by mass or less of the total mass of the toner particles.

Siloxane Compound Having Molecular Weight of 200 or More and 600 or Less

In the exemplary embodiment, it is preferable that the external additive A include a siloxane compound having a molecular weight of 200 or more and 600 or less and it is more preferable that the siloxane compound having a molecular weight of 200 or more and 600 or less be deposited on a part or the entirety of the surface of the external additive A in order to reduce the inconsistencies in gloss.

The siloxane compound may be a compound consisting of a siloxane bond and an alkyl group in order to reduce the inconsistencies in gloss.

The molecular weight of the siloxane compound may be 200 or more, is preferably 250 or more, is more preferably 280 or more, and is further preferably 300 or more in order to set the kinematic viscosity of the siloxane compound to be relatively high and thereby increase the friction force acting between the inorganic particles.

The molecular weight of the siloxane compound may be 600 or less, is preferably 550 or less, is more preferably 500 or less, and is further preferably 450 or less in order to set the electrical conductivity of the siloxane compound to be relatively high and thereby set the dielectric constant of the toner to be relatively large.

The number of Si atoms included in a molecule of the siloxane compound having a molecular weight of 200 or more and 600 or less is at least two.

The number of Si atoms included in a molecule of the siloxane compound having a molecular weight of 200 or more and 600 or less is preferably 3 or more, is more preferably 4 or more, and is further preferably 5 or more in order to increase the kinematic viscosity of the siloxane compound in a relative manner and thereby increase the friction force that acts between the inorganic particles.

The number of Si atoms included in a molecule of the siloxane compound having a molecular weight of 200 or more and 600 or less is preferably 7 or less, is more preferably 6 or less, and is further preferably 5 or less in order to increase the electrical conductivity of the siloxane compound in a relative manner and thereby increase the dielectric constant of the toner in a relative manner.

In consideration of the above two points, the number of Si atoms included in a molecule of the siloxane compound having a molecular weight of 200 or more and 600 or less is particularly preferably 5.

The kinematic viscosity of the siloxane compound having a molecular weight of 200 or more and 600 or less at 25° C. may be 2 $mm^2/s$ or more and 5 $mm^2/s$ or less in order to increase the friction force that acts between the inorganic particles to an adequate degree.

In the exemplary embodiment, the kinematic viscosity ($mm^2/s$) of siloxane is determined by dividing the viscosity of the siloxane at 25° C. which is measured with an Ostwald viscometer (a type of a capillary viscometer) by the density of the siloxane.

An example of the siloxane compound having a molecular weight of 200 or more and 600 or less is a linear siloxane compound, in which a siloxane bond is not branched.

Examples of a linear siloxane compound having a molecular weight of 200 or more and 600 or less include hexaalkyldisiloxane, octaalkyltrisiloxane, decaalkyltetrasiloxane, dodecaalkylpentasiloxane, tetradecaalkylhexasiloxane, and hexadecaalkylheptasiloxane (note that, the above siloxanes have a molecular weight of 200 or more and 600 or less).

Examples of the alkyl group included in the above linear siloxane compounds include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the linear siloxane compound may be identical to or different from one another.

Specific examples of the linear siloxane compound having a molecular weight of 200 or more and 600 or less include octamethyltrisiloxane, decamethyltetrasiloxane, dodecamethylpentasiloxane, tetradecamethylhexasiloxane, and hexadecamethylheptasiloxane.

An example of the siloxane compound having a molecular weight of 200 or more and 600 or less is a branched siloxane, in which a siloxane bond is branched.

Examples of a branched siloxane compound having a molecular weight of 200 or more and 600 or less include branched siloxane compounds such as 1,1,1,3,5,5,5-heptaalkyl-3-(trialkylsiloxy)trisiloxane, tetrakis(trialkylsiloxy)silane, and 1,1,1,3,5,5,7,7,7-nonaalkyl-3-(trialkylsiloxy)tetrasiloxane (note that, the above siloxanes have a molecular weight of 200 or more and 600 or less).

Examples of the alkyl group included in the above branched siloxane compounds include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the branched siloxane compound may be identical to or different from one another.

Specific examples of the branched siloxane compound having a molecular weight of 200 or more and 600 or less include methyltris(trimethylsiloxy)silane (molecular formula: $C_{10}H_{30}O_3Si_4$), tetrakis(trimethylsiloxy)silane (molecular formula: $C_{12}H_{36}O_4Si_5$), and 1,1,1,3,5,5,7,7,7-nonamethyl-3-(trimethylsiloxy)tetrasiloxane (molecular formula: $C_{12}H_{36}O_4Si_5$).

An example of the siloxane compound having a molecular weight of 200 or more and 600 or less is a cyclic siloxane compound that includes a ring structure consisting of a siloxane bond.

Examples of a cyclic siloxane compound having a molecular weight of 200 or more and 600 or less include hexaalkylcyclotrisiloxane, octaalkylcyclotetrasiloxane, decaalkylcyclopentasiloxane, dodecaalkylcyclohexasiloxane, tetradecaalkylcycloheptasiloxane, and hexadecaalkylcyclooctasiloxane (note that, the above siloxanes have a molecular weight of 200 or more and 600 or less).

Examples of the alkyl group included in the above cyclic siloxane compounds include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the cyclic low-molecular-weight siloxane may be identical to or different from one another.

Specific examples of the cyclic siloxane compound having a molecular weight of 200 or more and 600 or less include hexamethylcyclotrisiloxane, octamethylcyclotetrasiloxane, decamethylcyclopentasiloxane, dodecamethylcyclohexasiloxane, tetradecamethylcycloheptasiloxane, and hexadecamethylcyclooctasiloxane.

The siloxane compound having a molecular weight of 200 or more and 600 or less is preferably at least one selected from the group consisting of the linear siloxane compound and the branched siloxane compound, is more preferably the branched siloxane compound, and is further preferably a siloxane compound having a tetrakis structure in order to make it easy to increase the amount of charge stored in the toner including the siloxane compound to an intended degree as a result of stirring performed inside the developing device. The term "siloxane having a tetrakis structure" used herein refers to a siloxane including at least one structure represented by the following formula (i.e., a tetrakissiloxysilane structure) per molecule.

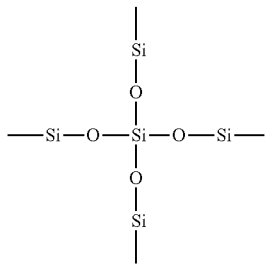

An example of the siloxane compound having a molecular weight of 200 or more and 600 or less and including a tetrakis structure is tetrakis(trialkylsiloxy)silane. Examples of the alkyl group included in the siloxane compound having a tetrakis structure include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The alkyl groups included in a molecule of the siloxane compound having a tetrakis structure may be identical to or different from one another.

The siloxane compound having a molecular weight of 200 or more and 600 or less is particularly preferably tetrakis (trimethylsiloxy)silane in order to make it easy to increase the amount of charge stored in the toner including the siloxane compound to an intended degree as a result of stirring performed inside the developing device.

The total amount of the siloxane compound having a molecular weight of 200 or more and 600 or less included in the toner is measured by a headspace method with a gas chromatograph mass spectrometer "GCMS-QP2020" produced by Shimadzu Corporation and a nonpolar column "Rtx-1, 10157" produced by Restek (thickness: 1.00 μm, length: 60 m, inside diameter: 0.32 mm). The specific measuring method is as described below.

The toner is charged into a vial. The vial is sealed with a cap and heated to 190° C. over 3 minutes. Subsequently, the volatile component inside the vial is introduced to the column. The siloxane compound having a molecular weight of 200 or more and 600 or less is detected under the following conditions.

Carriers gas type: Helium

Carriers gas pressure: 120 kPa (constant pressure) Oven temperature: 40° C. (5 minutes)→(15° C./min)→250° C. (6 minutes) (25 minutes in total)

Ion source temperature: 260° C.

Interface temperature: 260° C.

A calibration curve is prepared using reference solutions having different concentrations which are prepared by diluting a reference substance (tetrakis(trimethylsiloxy)silane1) with ethanol. The content of the siloxane compound is determined on the basis of the area of the peak corresponding to the siloxane compound having a molecular weight of 200 or more and 600 or less which occurs in the chromatograph of the sample and the calibration curve of the reference substance. In the case where plural peaks corresponding to the siloxane compound having a molecular weight of 200 or more and 600 or less occur in the chromatograph of the sample, the content of the siloxane compound is determined on the basis of the total area of the peaks and the calibration curve of the reference substance. Furthermore, the ratio (ppm) of the total amount of the siloxane compound having a molecular weight of 200 or more and 600 or less included in the toner to the total amount of the toner is calculated.

The total amount of the siloxane compound having a molecular weight of 200 or more and 600 or less included in the external additive A is preferably 1 ppm or more, is more preferably 5 ppm or more, is further preferably 10 ppm or more, is particularly preferably 15 ppm or more, and is most preferably 20 ppm or more of the total mass of the external additive A in order to increase the friction force that acts between the inorganic particles.

The total amount of the siloxane compound having a molecular weight of 200 or more and 600 or less included in the external additive A is preferably 1,000 ppm or less, is more preferably 500 ppm or less, is further preferably 200 ppm or less, is particularly preferably 100 ppm or less, and is most preferably 50 ppm or less of the total mass of the external additive A in order not to reduce the dielectric constant of the toner.

The above mass proportions are calculated by converting [Total amount of siloxane compound having molecular weight of 200 or more and 600 or less included in external additive A]/[Total mass of external additive A included in toner] into parts per million.

In the case where the external additive A is hydrophobized inorganic particles, the mass of the external additive A is the mass of the external additive A which have been subjected to a hydrophobic treatment, that is, includes the mass of the component derived from the hydrophobizing agent used for the hydrophobic treatment.

The siloxane compound having a molecular weight of 200 or more and 600 or less may be added to the external additive A by, for example, being added onto the surfaces of the toner particles; or by being used as an agent for treating the surfaces of particles of the external additive A (specifically, sol gel silica particles).

External Additive B

The electrostatic image developing toner according to the exemplary embodiment includes the toner particles and the external additives A and B. At least the external additive A is deposited on the surfaces of the toner particles. At least the external additive B is deposited on the external additive A. The external additive B includes an aggregate of two or more particles. The coverage of the toner particles with the external additive B is 3% by area or more with respect to the total surface area of the toner particles.

All of the particles of the external additive B included in the toner may be, but are not necessarily, present on the external additive A. In order to reduce the inconsistencies in gloss, it is preferable that 30% by number or more of the particles of the external additive B included in the toner be present on the external additive A, it is more preferable that 50% by number or more of the particles of the external additive B included in the toner be present on the external additive A, and it is particularly preferable that 70% by number or more of the particles of the external additive B included in the toner be present on the external additive A.

The external additive B includes aggregates of two or more particles. In other words, the external additive B is aggregated particles constituted by two or more primary particles aggregated with one another (such aggregated particles are also referred to as "secondary particles").

The external additive B is preferably aggregates of 2 to 10 particles, is more preferably aggregates of 2 to 8 particles, and is particularly preferably aggregates of 2 to 6 particles.

The external additive B may be inorganic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Among these, silica particles, titania particles, and silica titania composite particles are preferable. Silica particles are particularly preferable.

From the viewpoint of thin-line reproducibility, the external additive B is preferably particles prepared by a gas-phase method (hereinafter, such particles are referred to as "gas-phase method particles") and is more preferably silica particles prepared by a gas-phase method (hereinafter, such silica particles are referred to as "gas-phase method silica particles").

Moreover, from the viewpoint of thin-line reproducibility, it is preferable that the external additive A be wet-process silica particles and the external additive B be gas-phase method silica particles.

In the electrostatic image developing toner according to the exemplary embodiment, the coverage of the toner particles with the external additive B is 3% by area or more with respect to the total surface area of the toner particles. In order to reduce the inconsistencies in gloss, the above coverage is preferably 3% by area or more and 50% by area or less, is more preferably 5% by area or more and 30% by area or less, and is particularly preferably 10% by area or more and 30% by area or less.

In the electrostatic image developing toner according to the exemplary embodiment, the coverage of the toner particles with the external additive A is preferably 30% by area or more, is more preferably 50% by area or more, and is particularly preferably 50% by area or more and 100% by area or less with respect to the total surface area of the toner particles in order to reduce the inconsistencies in gloss.

In the electrostatic image developing toner according to the exemplary embodiment, the coverage of the toner particles with external additives including the external additives A and B is preferably 50% by area or more, is more preferably 60% by area or more, and is particularly preferably 70% by area or more and 100% by area or less with respect to the total surface area of the toner particles in order to reduce the inconsistencies in gloss.

In the exemplary embodiment, the coverages of the toner particles with the external additives A and B with respect to the total surface area of the toner particles are measured by the measuring method below.

An image of the toner is taken with a scanning electron microscope (SEM) "S-4700" produced by Hitachi, Ltd. The total surface area of the toner particles, the area of a region of the surfaces of the toner particles on which the external additive A is deposited, and the area of a region of the surfaces of the toner particles on which the external additive B is deposited are measured on the basis of the image.

The coverages of the toner particles with the external additives are calculated using Formulae (2) and (3) below.

External additive $B$ coverage [%]=(Area of region on which external additive $B$ is deposited)/(Total surface area of toner particles)×100 (2)

External additive $A$ coverage [%]=(Area of region on which external additive $A$ is deposited)/(Total surface area of toner particles)×100 (3)

The shape factor SF1 of the external additive B is preferably 135 or more, is more preferably 145 or more, and is particularly preferably 150 or more in order to reduce the inconsistencies in gloss.

The average primary particle size of the external additive B is preferably 5 nm or more and 90 nm or less, is more preferably 10 nm or more and 70 nm or less, and is particularly preferably 10 nm or more and 50 nm or less in order to reduce the inconsistencies in gloss.

The number average particle size (secondary particle size) of the external additive B is preferably 50 nm or more and 300 nm or less, is more preferably 100 nm or more and 200 nm or less, and is particularly preferably 120 nm or more and 180 nm or less in order to reduce the inconsistencies in gloss.

The content of the external additive B in the toner is preferably 0.01% by mass or more and 10% by mass or less, is more preferably 0.05% by mass or more and 5% by mass or less, and is further preferably 0.1% by mass or more and 1% by mass or less of the total mass of the toner particles in order to reduce the inconsistencies in gloss.

In the exemplary embodiment, the ratio $C^B/C^A$ is preferably 0.03 or more and 0.50 or less, is more preferably 0.05 or more and 0.30 or less, and is particularly preferably 0.10 or more and 0.25 or less in order to reduce the inconsistencies in gloss, where $C^A$ is the coverage of the toner particles with the external additive A with respect to the total surface area of the toner particles, and $C^B$ is the coverage of the toner particles with the external additive B with respect to the total surface area of the toner particles.

In the exemplary embodiment, it is preferable that the number average particle size of the secondary particles of the external additive B be larger than the number average particle size of the external additive A, it is more preferable that the value of the number average particle size of the secondary particles of the external additive B minus the number average particle size of the external additive A be 10 nm or more and 200 nm or less, and it is particularly preferable that the value of the number average particle size of the secondary particles of the external additive B minus the number average particle size of the external additive A be 30 nm or more and 150 nm or less in order to reduce the inconsistencies in gloss.

In the exemplary embodiment, it is preferable that the content of the external additive A be higher than the content of the external additive B, it is more preferable that the ratio of the content of the external additive A to the content of the external additive B be more than 1 and 3 or less, it is further preferable that the above ratio be more than 1 and 2 or less, and it is particularly preferable that the above ratio be more than 1 and 1.5 or less in order to reduce the inconsistencies in gloss.

The toner may include particles other than the external additive A or B as an external additive.

The number average size of the particles other than the external additive A or B which are used as an external additive is preferably 10 nm or more and 400 nm or less, is more preferably 20 nm or more and 200 nm or less, and is particularly preferably 40 nm or more and 100 nm or less.

The type of the external additive other than the external additive A or B is not limited. Examples of the other external additive include inorganic particles and organic particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

Examples of the organic particles include particles of a resin, such as a silicone resin, polystyrene, polymethyl methacrylate (PMMA), or a melamine resin; and particles of a cleaning lubricant, such as a metal salt of a higher fatty acid, such as zinc stearate, or a fluorine-containing resin.

The content of the external additive other than the external additive A or B may be lower than either the content of the external additive A or the content of the external additive B in order to reduce the inconsistencies in gloss.

Toner Particles

The toner particles include, for example, a binder resin and a release agent and may optionally include a colorant and other additives. The toner particles may include a binder resin, a colorant, and a release agent.

Binder Resin

Examples of the binder resin include vinyl resins that are homopolymers of the following monomers or copolymers of two or more monomers selected from the following monomers: styrenes, such as styrene, para-chlorostyrene, and α-methylstyrene; (meth)acrylates, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; ethylenically unsaturated nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; and olefins, such as ethylene, propylene, and butadiene.

Examples of the binder resin further include non-vinyl resins, such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

In particular, a styrene acrylate resin and a polyester resin are suitably used. A polyester resin is more suitably used.

The above binder resins may be used alone or in combination of two or more.

Examples of the binder resin include an amorphous (also referred to as "non-crystalline") resin and a crystalline resin.

The binder resin preferably includes a crystalline resin and more preferably includes an amorphous resin and a crystalline resin from the viewpoint of the image intensity of thin-lines.

The amount of the crystalline resin included in the binder resin is preferably 2% by mass or more and 30% by mass or less and is more preferably 5% by mass or more and 20% by mass or less of the total mass of the binder resin.

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 15° C. or less at a heating rate of 10° C./min.

On the other hand, the term "amorphous" resin used herein refers to a resin that exhibits an endothermic peak with a half-width of more than 15° C., that exhibits step-like endothermic change, or that does not exhibit a distinct endothermic peak.

Examples of the polyester resin include the polyester resins known in the related art.

A crystalline polyester resin may be used as a polyester resin in combination with an amorphous polyester resin. The amount of the crystalline polyester resin included in the binder resin is preferably 2% by mass or more and 30% by mass or less and is more preferably 5% by mass or more and 20% by mass or less of the total mass of the binder resin.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adduct and bisphenol A-propylene oxide adduct. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight average molecular weight Mw of the amorphous polyester resin is preferably 5,000 or more and 1,000,000 or less and is more preferably 7,000 or more and 500,000 or less.

The number average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight average molecular weight and number average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight average molecular weight and number average molecular weight of the amorphous polyester resin are determined on the basis of the results of the measurement using a molecular-weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less, the pressure inside the reaction system is reduced as needed, and water and alcohols that are generated by condensation are removed.

In the case where the raw materials, that is, the monomers, are not dissolved in or miscible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where the monomers have low miscibility with each other, a condensation reaction of the monomers with an acid or alcohol that is to undergo a polycondensation reaction with the monomers may be performed in advance and subsequently polycondensation of the resulting polymers with the other components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of forming a crystal structure, a condensation polymer prepared using a polymerizable monomer including a linear aliphatic compound may be used as a crystalline polyester resin instead of a condensation polymer prepared using a polymerizable monomer including an aromatic compound.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The crystalline polyester resin may have a weight average molecular weight Mw of 6,000 or more and 35,000 or less.

The crystalline polyester resin may be produced by any suitable method known in the related art similarly to, for example, the amorphous polyester resin.

Hybrid Resin Including Polyester Resin Segment and Styrene Acrylate Copolymer Segment The binder resin may include a hybrid resin that includes a polyester resin segment and a styrene acrylate copolymer segment. Hereinafter, this hybrid resin is referred to simply as "hybrid resin".

Average Molecular Weight of Hybrid Resin

The weight average molecular weight Mw of the binder resin is preferably 10,000 or more and 200,000 or less, is more preferably 50,000 or more and 120,000 or less, and is particularly preferably 60,000 or more and 110,000 or less in order to reduce the inconsistencies in gloss.

The z-average molecular weight Mz of the binder resin is preferably 100,000 or more and 2,000,000 or less, is more preferably 200,000 or more and 1,300,000 or less, and is particularly preferably 400,000 or more and 1,000,000 or less in order to reduce the inconsistencies in gloss.

The average molecular weights of the binder resin are determined by gel permeation chromatography (GPC). Specifically, the molecular weights of the binder resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. Then, a molecular weight distribution curve (molecular weight calibration curve) is prepared on the basis of the measurement results using monodisperse polystyrene standard samples. The weight average molecular weight Mw and z-average molecular weight Mz of the binder resin are determined on the basis of the molecular weight calibration curve.

Gel Fraction in Hybrid Resin

The gel fraction in the hybrid resin is preferably 1% by mass or more and 20% by mass or less, is more preferably 3% by mass or more and 15% by mass or less, and is particularly preferably 4% by mass or more and 10% by mass or less in order to reduce the inconsistencies in gloss.

The gel fraction in the hybrid resin is measured in accordance with JIS K6796 (1998). Specifically, the hybrid resin is taken from the toner and the mass of the hybrid resin is measured, which is considered the mass of the hybrid resin before solvent extraction. The hybrid resin is subsequently immersed in tetrahydrofuran at 45° C. for 24 hours. Subsequently, filtering is performed to separate and collect the residue. The residue is dried, and the mass of the residue is measured, which is considered the dry mass of the residue after extraction. The gel fraction is calculated using the following formula.

Gel fraction (%)=((Dry mass of residue after extraction)/(Mass of hybrid resin before solvent extraction))×100

The gel fraction in the hybrid resin may be adjusted by adding a trivalent or higher carboxylic acid or a trihydric or higher alcohol to the polyester resin segment.

However, the followings are considered although the mechanisms by which the "reduction in inconsistencies in gloss" of an image in which the toner deposition density per unit area is high is enhanced are not clear in detail.

It is necessary to finely disperse the hybrid resin in the toner through the use of the proximity of the aromatic compounds, such as styrene, and the aromatic compounds included in the pigment due to the π-π interaction.

In addition, since the three-dimensional structure of styrene is effective for the fine dispersion of styrene, it is necessary to perform gelation in the styrene acrylate copolymer.

An acrylate monomer having two or more unsaturated bonds is effective for forming the three dimensional structure in the styrene acrylate copolymer segment. A di(meth)acrylate and a multifunctional (meth)acrylate are preferable.

Examples of the di(meth)acrylate include polyethylene glycol diacrylate, 1,6-hexanediol diacrylate, 1,9-nonanediol diacrylate, and 1,10-decanediol diacrylate. Examples of the multifunctional (meth)acrylate include pentaerythritol triacrylate, trimethylolpropane triacrylate, and pentaerythritol tetraacrylate.

Polyester Resin Segment

The polyester resin segment of the hybrid resin may be, for example, a polycondensate of an alcohol component (a-al) and a carboxylic acid component (a-ac). Since the hybrid resin includes the polyester resin segment, a toner having excellent low-temperature fixability may be produced.

Examples of the alcohol component (a-al) include linear and branched aliphatic diols, aromatic diols, alicyclic diols, and trihydric or higher alcohols. Among these, aromatic diols are preferable. In order to enhance the low-temperature fixability and the image density of a printed material, an alkylene oxide adduct of bisphenol A is more preferable.

The alkylene oxide adduct of bisphenol A is preferably at least one selected from the group consisting of an ethylene oxide adduct of bisphenol A (2,2-bis(4-hydroxyphenyl)propane) and a propylene oxide adduct of bisphenol A and is more preferably a propylene oxide adduct of bisphenol A.

The average number of moles of alkylene oxide included in the alkylene oxide adduct of bisphenol A is preferably 1 or more, is more preferably 1.2 or more, and is further preferably 1.5 or more; and is preferably 16 or less, is more preferably 12 or less, is further preferably 8 or less, and is particularly preferably 4 or less.

The proportion of the alkylene oxide adduct of bisphenol A to the alcohol component (a-al) is preferably 80 mol % or more, is more preferably 90 mol % or more, is further preferably 95 mol % or more, is particularly preferably 98 mol % or more and 100 mol % or less, and is most preferably 100 mol %.

The alcohol component (a-al) may include an alcohol component other than an alkylene oxide adduct of bisphenol A. Examples of the other alcohol component include linear and branched aliphatic diols, other aromatic diols, alicyclic diols, and trihydric and higher alcohols.

Examples of the linear and branched aliphatic diols include ethylene glycol, 1,2-propanediol, 1,3-propanediol, 1,2-butanediol, 1,3-butanediol, 1,4-butanediol, 2,3-butanediol, 2,2-dimethyl-1,3-propanediol, 1,6-hexanediol, 1,8-octanediol, 1,9-nonanediol, 1,10-decanediol, and 1,12-dodecanediol.

Examples of the alicyclic diols include hydrogenated bisphenol A (i.e., 2,2-bis(4-hydroxycyclohexyl)propane) and an adduct of hydrogenated bisphenol A with an alkylene oxide having 2 to 4 carbon atoms (average number of moles of adducts: 2 or more and 12 or less).

Examples of the trihydric and higher alcohols include glycerin, pentaerythritol, trimethylolpropane, and sorbitol.

The above alcohol components may be used alone or in combination of two or more.

Examples of the carboxylic acid component (a-ac) include a dicarboxylic acid and a polyvalent carboxylic acid with a valence of three or more.

Examples of the dicarboxylic acid include an aromatic dicarboxylic acid, a linear or branched aliphatic dicarboxylic acid, and an alicyclic dicarboxylic acid. Among these, at least one compound selected from the group consisting of an aromatic dicarboxylic acid and a linear or branched aliphatic dicarboxylic acid is preferable.

Examples of the aromatic dicarboxylic acid include phthalic acid, isophthalic acid, and terephthalic acid. Among these, at least one compound selected from the group consisting of isophthalic acid and terephthalic acid is preferable, and terephthalic acid is more preferable.

The proportion of the aromatic dicarboxylic acid in the carboxylic acid component (a-ac) is preferably 20 mol % or more, is more preferably 25 mol % or more, and is further preferably 30 mol % or more; and is preferably 90 mol % or less, is more preferably 70 mol % or less, and is further preferably 50 mol % or less.

The number of carbon atoms included in the linear or branched aliphatic dicarboxylic acid is preferably 2 or more and is more preferably 3 or more; and is preferably 30 or less and is more preferably 20 or less.

Examples of a linear or branched aliphatic dicarboxylic acid having 2 to 30 carbon atoms include oxalic acid, malonic acid, maleic acid, fumaric acid, citraconic acid, itaconic acid, glutaconic acid, succinic acid, adipic acid, sebacic acid, dodecanedioic acid, azelaic acid, and succinic acid substituted with an alkyl group having 1 to 20 carbon atoms or with an alkenyl group having 2 to 20 carbon atoms.

Examples of the succinic acid substituted with an alkyl group having 1 to 20 carbon atoms or with an alkenyl group having 2 to 20 carbon atoms include dodecylsuccinic acid, dodecenylsuccinic acid, and octenylsuccinic acid.

Among these, at least one compound selected from the group consisting of terephthalic acid, sebacic acid, and fumaric acid is preferable. It is more preferable that the above compounds be used in combination of two or more.

The polyvalent carboxylic acid with a valence of three or more may be a trivalent carboxylic acid, such as trimellitic acid.

In the case where the carboxylic acid component (a-ac) includes the polyvalent carboxylic acid with a valence of three or more, the proportion of the polyvalent carboxylic acid with a valence of three or more in the carboxylic acid component (a-ac) is preferably 3 mol % or more and is more preferably 5 mol % or more; and is preferably 20 mol % or less, is more preferably 15 mol % or less, and is further preferably 12 mol % or less.

The above carboxylic acid components may be used alone or in combination of two or more.

The ratio of the carboxyl group included in the carboxylic acid component (a-ac) to the hydroxyl group included in the alcohol component (a-al), that is, [COOH group]/[OH group], is preferably 0.7 or more and is more preferably 0.8 or more; and is preferably 1.3 or less and is more preferably 1.2 or less.

Styrene Acrylate Copolymer Segment

Examples of a styrene compound used for forming the styrene acrylate copolymer segment include a styrene that may have a substituent. Examples of the substituent include an alkyl group having 1 to 5 carbon atoms, a halogen atom, an alkoxy group having 1 to 5 carbon atoms, a sulfonic group, and salts thereof.

Examples of the styrene compound include styrenes, such as styrene, methylstyrene, α-methylstyrene, β-methylstyrene, tert-butylstyrene, chlorostyrene, chloromethylstyrene, methoxystyrene, styrenesulfonic acid, and salts thereof.

Among these, styrene is preferable.

The proportion of the styrene compound (preferably, styrene) in the raw material monomers used for forming the styrene acrylate copolymer segment is preferably 50% by mass or more and 95% by mass or less, is more preferably 55% by mass or more and 90% by mass or less, and is particularly preferably 60% by mass or more and 85% by mass or less in order to reduce the inconsistencies in gloss.

The content of the monomer unit derived from the styrene compound (preferably, styrene) (hereinafter, referred to also as "monomer unit formed by styrene") is preferably 50% by mass or more and 95% by mass or less, is more preferably 55% by mass or more and 90% by mass or less, and is particularly preferably 60% by mass or more and 85% by mass or less of the total mass of the styrene acrylate copolymer segment in order to reduce the inconsistencies in gloss.

The content of the constitutional unit derived from styrene in the hybrid resin is preferably 1% by mass or more and 50% by mass or less, is more preferably 3% by mass or more and 40% by mass or less, is further preferably 5% by mass or more and 20% by mass or less, and is particularly preferably 8% by mass or more and 20% by mass or less of the total mass of the hybrid resin in order to reduce the inconsistencies in gloss.

The (meth)acrylic acid compound used for forming the styrene acrylate copolymer segment is preferably, for example, a (meth)acrylate, a (meth)acrylamide, (meth) acrylic acid, or a (meth) acrylonitrile; is more preferably, for example, a (meth)acrylate; and is particularly preferably, for example, an alkyl ester of (meth)acrylate. In the case where the (meth)acrylic acid compound is an alkyl ester of (meth) acrylate, the hydrocarbon group is the residue located on the alcohol-side of the ester.

Examples of the alkyl ester of (meth)acrylate include (iso)propyl (meth)acrylate, (iso)butyl (meth)acrylate, (iso) hexyl (meth)acrylate, cyclohexyl (meth)acrylate, (iso)octyl (meth)acrylate (hereinafter, referred to also as "2-ethylhexyl (meth)acrylate"), (iso)decyl (meth)acrylate, (iso)dodecyl (meth)acrylate (hereinafter, referred to also as "(iso)lauryl (meth)acrylate"), (iso)palmityl (meth)acrylate, (iso)stearyl (meth)acrylate, and (iso)behenyl (meth)acrylate.

Among these, 2-ethylhexyl (meth)acrylate, (iso)decyl (meth)acrylate, (iso)dodecyl (meth)acrylate, (iso)stearyl (meth)acrylate, and (iso)behenyl (meth)acrylate are preferable; 2-ethylhexyl (meth) acrylate, (iso)dodecyl (meth)acrylate, and (iso)stearyl (meth)acrylate are more preferable; (iso)dodecyl (meth)acrylate and (iso)stearyl (meth)acrylate are further preferable; and (iso)stearyl (meth)acrylate is further more preferable.

The term "alkyl (meth)acrylate" used herein refers to alkyl acrylate or alkyl methacrylate. As for the position of alkyl, the term "(iso)" used herein refers to n-alkyl or iso-alkyl.

The proportion of the (meth)acrylic acid compound in the raw material monomers used for forming the styrene acrylate copolymer segment is preferably 5% by mass or more and 50% by mass or less, is more preferably 10% by mass or more and 45% by mass or less, and is particularly preferably 15% by mass or more and 40% by mass or less in order to reduce the inconsistencies in gloss.

The content of the monomer unit derived from the (meth) acrylic acid compound is preferably 5% by mass or more and 50% by mass or less, is more preferably 10% by mass or more and 45% by mass or less, and is particularly preferably 15% by mass or more and 40% by mass or less of the total mass of the styrene acrylate copolymer segment in order to reduce the inconsistencies in gloss.

Examples of other raw material monomers include ethylenically unsaturated monoolefins, such as ethylene and propylene; conjugated dienes, such as butadiene; halovinyls, such as vinyl chloride; vinyl esters, such as vinyl acetate and vinyl propionate; (meth)acrylate aminoalkyl esters, such as dimethylaminoethyl (meth)acrylate; vinyl ethers, such as methyl vinyl ether; vinylidene halides, such as vinylidene chloride; and N-vinyl compounds, such as N-vinylpyrrolidone.

Unit Derived from Bireactive Monomer

The hybrid resin may include a unit derived from a bireactive monomer from the viewpoint of the image density of a printed material. When a bireactive monomer is used as a raw material monomer for the hybrid resin, the bireactive monomer reacts with each of the polyester resin segment and the styrene acrylate copolymer segment or each of the raw material monomers for the polyester resin segment and the styrene acrylate copolymer segment to form a junction between the polyester resin segment and the styrene acrylate copolymer segment.

The term "unit derived from bireactive monomer" used herein refers to a unit produced by the reaction of a functional group included in the bireactive monomer, that is, a vinyl portion.

Examples of the bireactive monomer include vinyl monomers that include at least one functional group selected from the group consisting of a hydroxyl group, a carboxyl group, an epoxy group, a primary amino group, and a secondary amino group in the molecule. Among these, from the viewpoint of reactivity, a vinyl monomer including a hydroxyl group or carboxyl group is preferable, and a vinyl monomer including a carboxyl group is more preferable.

Examples of the bireactive monomer include acrylic acid, methacrylic acid, fumaric acid, and maleic acid. Among these, from the viewpoint of the reactivities in a polycondensation reaction and an addition polymerization reaction, acrylic acid and methacrylic acid are preferable, and acrylic acid is more preferable.

The content of the unit derived from the bireactive monomer in the hybrid resin is preferably 1 molar part or more, is more preferably 5 molar parts or more, and is further preferably 8 molar parts or more; and is preferably 30 molar parts or less, is more preferably 25 molar parts or less, and is further preferably 20 molar parts or less relative to 100 molar parts of the alcohol component of the polyester resin segment of the hybrid resin in order to further increase the image density of a printed material. In the case where the bireactive monomer is used, the amount of the constitutional unit derived from the bireactive monomer is included in the amount of the polyester resin segment in the calculation of the amounts of the segments of the hybrid resin.

The content of the polyester resin segment in the hybrid resin is preferably 40% by mass or more, is more preferably 50% by mass or more, and is further preferably 55% by mass or more; and is preferably 95% by mass or less, is more preferably 85% by mass or less, and is further preferably 80% by mass or less of the total mass of the hybrid resin in order to reduce the inconsistencies in gloss.

The content of the styrene acrylate copolymer segment in the hybrid resin is preferably 10% by mass or more, is more preferably 15% by mass or more, and is further preferably 20% by mass or more; and is preferably 60% by mass or less, is more preferably 50% by mass or less, and is further preferably 45% by mass or less of the total mass of the hybrid resin in order to reduce the inconsistencies in gloss.

The total content of the polyester resin segment and the styrene acrylate copolymer segment in the hybrid resin is preferably 80% by mass or more and 100% by mass or less, is more preferably 90% by mass or more and 100% by mass or less, is further preferably 93% by mass or more and 100% by mass or less, and is particularly preferably 95% by mass or more and 100% by mass or less of the total mass of the hybrid resin in order to reduce the inconsistencies in gloss.

The softening temperature Tm of the hybrid resin is preferably 70° C. or more, is more preferably 90° C. or more, and is further preferably 100° C. or more; and is preferably 140° C. or less, is more preferably 130° C. or less, and is further preferably 125° C. or less from the viewpoint of reduction in the inconsistencies in gloss.

The softening temperature Tm of a resin is the temperature (½ discharge temperature) at which the plunger stroke is ½ of the height of an S-shaped plunger stroke-temperature curve obtained by measuring 1 g of the resin using "FLOW-TESTER CFT-500C" produced by Shimadzu Corporation at a load of 10 kgf/cm$^2$ with a nozzle having a diameter of 1 mm and a length of 1 mm, after preheating at 80° C. for 5 minutes, at a heating rate of 6° C./min.

The glass transition temperature of the hybrid resin is preferably 30° C. or more, is more preferably 35° C. or more, and is further preferably 40° C. or more; and is preferably 70° C. or less, is more preferably 60° C. or less, and is further preferably 55° C. or less from the viewpoint of reduction in inconsistencies in the density of an image formed using the toner.

The glass transition temperature Tg of a resin is measured by the method described below.

The acid value of the hybrid resin is preferably 5 mgKOH/g or more, is more preferably 10 mgKOH/g or more, and is further preferably 15 mgKOH/g or more; and is preferably 40 mgKOH/g or less, is more preferably 35 mgKOH/g or less, and is further preferably 30 mgKOH/g or less from the viewpoint of reduction in inconsistencies in the density of an image formed using the toner.

Acid value represents the number of milligrams of potassium hydroxide required to neutralize acidic groups (e.g., carboxyl group) included in one gram of a sample. In the exemplary embodiment, acid value is measured in accordance with the method described in JIS K0070-1992 (potentiometric titration method).

In the case where the hybrid resin is neutralized, the acid value of the hybrid resin is measured after the acidic group (e.g., carboxyl group) has been retrieved by reducing pressure and optionally heating the hybrid resin to remove the neutralizer or by treating the hybrid resin with an acid. In the case where the sample is insoluble, dioxane, tetrahydrofuran (THF), and the like may be used as a solvent.

The softening point, glass transition temperature, and acid value of the hybrid resin may be adjusted appropriately by changing the manufacturing conditions, such as the types and amounts of the raw material monomers, the reaction temperature, the reaction time, and cooling rate. The softening point, glass transition temperature, and acid value of the hybrid resin are determined by the methods described in Examples below.

In the case where two or more hybrid resins are used in combination, the softening point, glass transition temperature, and acid value of a mixture of the hybrid resins may fall within the respective ranges described above.

A method for preparing the hybrid resin includes, for example, conducting polycondensation of the alcohol component (a-al) with the carboxylic acid component (a-ac) and conducting an addition polymerization reaction using the raw material monomers of the styrene acrylate copolymer segment and the bireactive monomer. Specific examples of the method include (i) to (iii) below.

(i) A method in which the polycondensation reaction of the alcohol component (a-al) with the carboxylic acid component (a-ac) is conducted and, subsequently, the addition polymerization reaction using the raw material monomers of the styrene acrylate copolymer segment and the bireactive monomer is conducted From the viewpoint of reactivity, the raw material monomers of the styrene acrylate copolymer segment and the bireactive monomer may be fed to the reaction system at a time. From the viewpoint of reactivity, a catalyst, such as an esterification catalyst or an esterification promoter, may be used. A radical polymerization initiator and a radical polymerization inhibitor may also be used.

In order to promote the polycondensation reaction and, as needed, the reaction with the bireactive monomer, a part of the carboxylic acid component may be used for the polycondensation reaction and the remaining part may be added to the reaction system after the reaction temperature has been again increased subsequent to the addition polymerization reaction.

The hybrid resin may be produced by the method (ii) or (iii) below.

(ii) A method in which the addition polymerization reaction using the raw material monomers of the styrene acrylate copolymer segment and the bireactive monomer is conducted and, subsequently, the polycondensation reaction of the raw material monomers of the polyester resin segment is conducted.

(iii) A method in which the polycondensation reaction of the alcohol component with the carboxylic acid component and the addition polymerization reaction using the raw material monomers of the styrene acrylate copolymer segment and the bireactive monomer are conducted simultaneously.

In the methods (i) to (iii), the polycondensation reaction and the addition polymerization reaction may be conducted in the same container.

The method (i) or (ii) is preferably used for producing the hybrid resin in order to increase the degree of freedom of the reaction temperature in the polycondensation reaction. The method (i) is more preferably used.

In the polycondensation reaction, polycondensation of the alcohol component (a-al) with the carboxylic acid component (a-ac) is performed. Optionally, the following compounds may be used in the polycondensation reaction: 0.01 parts by mass or more and 5 parts by mass or less of an esterification catalyst, such as tin(II) di(2-ethylhexanoate), dibutyltin oxide, or titanium diisopropylate bistriethanol aminate, relative to 100 parts by mass of the total amount of the alcohol component and the carboxylic acid component; 0.001 parts by mass or more and 0.5 parts by mass or less of an esterification promoter, such as gallic acid (i.e., 3,4,5-trihydroxybenzoic acid), relative to 100 parts by mass of the total amount of the alcohol component and the carboxylic acid component; and 0.001 parts by mass or more and 0.5 parts by mass or less of a radical polymerization inhibitor, such as 4-tert-butylcatechol, relative to 100 parts by mass of the total amount of the alcohol component and the carboxylic acid component.

The temperature at which the polycondensation reaction is conducted is preferably 120° C. or more, is more preferably 160° C. or more, and is further preferably 180° C. or more; and is preferably 250° C. or less and is more preferably 230° C. or less.

The polycondensation reaction may be conducted in an inert gas atmosphere.

In the addition polymerization reaction, addition polymerization is performed using the raw material monomers of the styrene acrylate copolymer segment and the bireactive monomer.

The temperature at which the addition polymerization reaction is conducted is preferably 110° C. or more and is more preferably 130° C. or more; and is preferably 220° C. or less and is more preferably 200° C. or less. The pressure inside the reaction system may be reduced in the latter part of the polymerization reaction in order to promote the polymerization reaction.

Examples of the polymerization initiator used for the addition polymerization reaction include the following known radical polymerization initiators: peroxides, such as dibutyl peroxide; persulfates, such as sodium persulfate; and azo compounds, such as 2,2'-azobis(2,4-dimethyl)valeronitrile).

The amount of the radical polymerization initiator used is preferably 1 part by mass or more and is more preferably 5 parts by mass or more; and is preferably 20 parts by mass or less and is more preferably 15 parts by mass or less, relative to 100 parts by mass of the raw material monomers of the styrene acrylate copolymer segment.

The weight average molecular weight Mw of the binder resin is preferably 5,000 or more and 1,000,000 or less, is more preferably 7,000 or more and 500,000 or less, and is particularly preferably 25,000 or more and 60,000 or less from the viewpoint of the abrasion resistance of the image. The number average molecular weight Mn of the binder resin may be 2,000 or more and 100,000 or less. The molecular weight distribution Mw/Mn of the binder resin is preferably 1.5 or more and 100 or less and is more preferably 2 or more and 60 or less.

The weight average and number average molecular weights of the binder resin are determined by gel permeation chromatography (GPC). Specifically, the molecular weights of the binder resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight average and number average molecular weights of the binder resin are determined on the basis of a molecular weight calibration curve prepared on the basis of the measurement results using monodisperse polystyrene standard samples.

The content of the binder resin in the toner particles is preferably 40% by mass or more and 95% by mass or less, is more preferably 50% by mass or more and 90% by mass or less, and is further preferably 60% by mass or more and 85% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less.

The melting temperature of the release agent is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The domain diameter of the release agent included in the toner particles is preferably 200 nm or more and 2,000 nm or less, is more preferably 400 nm or more and 1,500 nm or less, is further preferably 500 nm or more and 1,300 nm or less, and is particularly preferably 600 nm or more and 1,200 nm or less in order to reduce the inconsistencies in gloss.

The domain diameter of the release agent (i.e., the average diameter of domains of the release agent) is the value determined by the following method.

The toner particles (or the toner) are mixed with an epoxy resin so as to be buried in the epoxy resin. The epoxy resin is subsequently caused to solidify. The resulting solid is cut with an ultramicrotome "Ultracut UCT" produced by Leica Microsystems into a thin specimen having a thickness of 80 nm or more and 130 nm or less. The thin specimen is dyed with ruthenium tetroxide for 3 hours in a desiccator kept at 30° C. A SEM image of the dyed thin specimen is taken with an ultra-high resolution field emission electron scanning microscope (FE-SEM) "S-4800" produced by Hitachi High-Technologies Corporation.

In a cross section of the toner particles, the domains of the colorant can be distinguished from those of the release agent by size, since the domains of the colorant are smaller than those of the release agent. The domains of the colorant can be distinguished from those of the release agent also by the depth of the color of the domains of the release agent.

In the SEM image, the cross sections of 30 toner particles having a maximum length that is 85% or more of the volume average size of the toner particles are selected, and 100 dyed domains of the release agent are observed in total. The maximum length of each of the domains is measured and considered the long-axis diameter of the domain. The arithmetic average thereof is considered the average diameter of the domains (hereinafter, referred to as "domain diameter").

In the electrostatic image developing toner according to the exemplary embodiment, it is preferable that 30% by mass or more of the release agent be present in a region extending from the surfaces of the toner particles to a distance of 0.8 μm from the surfaces of the toner particles in order to reduce the inconsistencies in gloss. It is more preferable that 50% by mass or more of the release agent be present in the above region. It is particularly preferable that 70% by mass or more of the release agent be present in the above region.

In order to reduce the inconsistencies in gloss, the toner particles may be core-shell particles and the shell layers of the core-shell particles may include the release agent.

In the exemplary embodiment, the proportion of the release agent present in the region extending from the surfaces of the toner particles to a distance of 0.8 μm from the surfaces of the toner particles is determined by the following method.

The toner particles are buried using a bisphenol-A liquid epoxy resin and a curing agent to prepare a sample that is to be cut. The sample is cut with a cutting machine equipped with a diamond knife, such as a LEICA ultramicrotome, at −100° C. to form an observation sample. The observation sample is left to stand in a desiccator kept in a ruthenium tetroxide atmosphere in order to dye the observation sample. Whether or not the observation sample has been dyed is determined in accordance with the degree at which a tape that has been left to stand in the desiccator at the same time as the observation sample is dyed. The observation sample dyed in the above manner is observed with a scanning transmission electron microscope (STEM).

Since the toner sample has been dyed with ruthenium tetroxide, the binder resin portion (i.e., the region other than the release agent or the colorant) and the release agent portion can be distinguished from each other by the difference in the depth of color and shape. A rod- or block-like portion inside the toner which appears whiter is considered the release agent.

In the cross section of the toner particles of the observation sample, 20 toner particles are extracted and the area of the release agent in the toner particles is measured with image processing software "WinROOF" produced by MITANI CORPORATION. Then, the area of the release agent present in the region extending from the surfaces of the toner particles to a distance of 0.8 μm from the surfaces of the toner particles is measured. The ratio of the area of the release agent present in the region extending to a distance of 0.8 μm to the area of the release agent included in the toner particles is calculated.

The content of the release agent in the toner particles is preferably 1% by mass or more and 20% by mass or less and is more preferably 5% by mass or more and 15% by mass or less.

Colorant

Examples of the colorant include pigments, such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is, for example, preferably 1% by mass or more and 30% by mass or less and is more preferably 3% by mass or more and 15% by mass or less.

Other Additives

Examples of the other additives include additives known in the related art, such as a magnetic substance, a charge-controlling agent, and an inorganic powder. These additives may be added to the toner particles as internal additives.

Properties, etc. of Toner Particles

The toner particles may have a single-layer structure or a "core-shell" structure constituted by a core (i.e., core particle) and a coating layer (i.e., shell layer) covering the core. Hereinafter, particles having a core-shell structure are referred to as "core-shell particles". The core-shell structure of the toner particles may be constituted by, for example, a core including a binder resin and, as needed, other additives such as a colorant and a release agent and by a coating layer including the binder resin.

The toner particles may be core-shell particles in order to reduce the inconsistencies in gloss.

The volume average diameter $D_{50v}$ of the toner particles is preferably 2 μm or more and 10 μm or less and is more preferably 4 μm or more and 8 μm or less.

The volume average diameter of the toner particles is measured using "COULTER MULTISIZER II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5 mass %-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the diameters of particles having a diameter of 2 μm or more and 60 μm or less are measured using COULTER MULTISIZER II with an aperture having a diameter of 100 μm. The number of the particles sampled is 50,000.

A volume particle size cumulative distribution is drawn in ascending order in terms of particle size. The particle size at which the cumulative volume reaches 50% is considered the volume average particle size $D_{50v}$.

In the exemplary embodiment, the average circularity of the toner particles is preferably, but not limited to, 0.91 or more and 0.98 or less, is more preferably 0.94 or more and 0.98 or less, and is further preferably 0.95 or more and 0.97 or less in order to increase ease of removing toner particles from the image holding member.

In the exemplary embodiment, the circularity of a toner particle is calculated as [Perimeter of circle having an area equal to the projection area of the particle]/[Perimeter of the projection image of the particle]. The average circularity of the toner particles is the circularity at which the cumulative number reaches 50% in a number circularity distribution drawn in ascending order in terms of circularity. The average circularity of the toner particles is determined by analyzing at least 3,000 toner particles with a flow particle image analyzer.

The average circularity of the toner particles may be controlled by, for example, in the case where the toner particles are produced by aggregation coalescence, adjusting the speed at which the dispersion liquid is stirred or the temperature or holding time of the dispersion liquid in the fusion-coalescence step.

Method for Producing Toner

A method for producing the toner according to the exemplary embodiment is described below.

The toner according to the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, a method for preparing the toner particles is not limited thereto, and any suitable method known in the related art may be used. Among these methods, aggregation coalescence may be used in order to prepare the toner particles.

In knead pulverization, a toner forming material including the binder resin, the release agent, and optionally the colorant is kneaded to form a kneaded mixture, and the kneaded mixture is pulverized to form toner particles.

Specifically, in the case where, for example, aggregation coalescence is used in order to prepare the toner particles, the toner particles are prepared by the following steps:

preparing a resin particle dispersion liquid in which resin particles serving as a binder resin are dispersed (i.e., resin particle dispersion liquid preparation step);

causing the resin particles (and, as needed, other particles) to aggregate together in the resin particle dispersion liquid (or in the resin particle dispersion liquid mixed with another particle dispersion liquid as needed) in order to form aggregated particles (i.e., aggregated particle formation step);

and heating the resulting aggregated particle dispersion liquid in which the aggregated particles are dispersed in order to cause fusion and coalescence of the aggregated particles to occur and thereby form toner particles (fusion-coalescence step).

Each of the above steps is described below in detail.

Hereinafter, a method for preparing toner particles including a colorant and a release agent is described. However, it should be noted that the colorant and the release agent are optional. It is needless to say that additives other than a colorant and a release agent may be used.

Resin Particle Dispersion Liquid Preparation Step

In addition to a resin particle dispersion liquid in which resin particles serving as a binder resin is dispersed, for example, a colorant particle dispersion liquid in which colorant particles are dispersed and a release agent particle dispersion liquid in which release agent particles are dispersed are prepared.

The resin particle dispersion liquid is prepared by, for example, dispersing resin particles in a dispersion medium using a surfactant.

Examples of the dispersion medium used for preparing the resin particle dispersion liquid include aqueous media.

Examples of the aqueous media include water, such as distilled water and ion-exchange water; and alcohols. These aqueous media may be used alone or in combination of two or more.

Examples of the surfactant include anionic surfactants, such as sulfate surfactants, sulfonate surfactants, and phosphate surfactants; cationic surfactants, such as amine salt surfactants and quaternary ammonium salt surfactants; and nonionic surfactants, such as polyethylene glycol surfactants, alkylphenol ethylene oxide adduct surfactants, and polyhydric alcohol surfactants. Among these surfactants, in particular, the anionic surfactants and the cationic surfactants may be used. The nonionic surfactants may be used in combination with the anionic surfactants and the cationic surfactants.

These surfactants may be used alone or in combination of two or more.

In the preparation of the resin particle dispersion liquid, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the dispersion medium by, for example, phase-inversion emulsification. Phase-inversion emulsification is a method in which the resin to be dispersed is dissolved in a hydrophobic organic solvent in which the resin is soluble, a base is added to the resulting organic continuous phase (i.e., O phase) to perform neutralization, and subsequently an aqueous medium (i.e., W phase) is charged in order to perform phase inversion from W/O to O/W and disperse the resin in the aqueous medium in the form of particles.

The volume average diameter of the resin particles dispersed in the resin particle dispersion liquid is preferably, for example, 0.01 μm or more and 1 μm or less, is more preferably 0.08 μm or more and 0.8 μm or less, and is further preferably 0.1 μm or more and 0.6 μm or less.

The volume average diameter of the resin particles is determined in the following manner. The particle diameter distribution of the resin particles is obtained using a laser-diffraction particle-size-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw a cumulative distribution curve. A particle diameter at which the cumulative volume reaches 50% is considered to be the volume particle diameter $D_{50v}$. The volume average diameters of particles included in the other dispersion liquids are also determined in the above-described manner.

The content of the resin particles included in the resin particle dispersion liquid is preferably 5% by mass or more and 50% by mass or less and is more preferably 10% by mass or more and 40% by mass or less.

The colorant particle dispersion liquid, the release agent particle dispersion liquid, and the like are also prepared as in the preparation of the resin particle dispersion liquid. In other words, the above-described specifications for the volume average diameter of the particles included in the resin particle dispersion liquid, the dispersion medium of the resin particle dispersion liquid, the dispersion method used for preparing the resin particle dispersion liquid, and the content of the particles in the resin particle dispersion liquid can also be applied to colorant particles dispersed in the colorant particle dispersion liquid and release agent particles dispersed in the release agent particle dispersion liquid.

Aggregated Particle Formation Step

The resin particle dispersion liquid is mixed with the colorant particle dispersion liquid and the release agent particle dispersion liquid.

In the resulting mixed dispersion liquid, heteroaggregation of the resin particles with the colorant particles and the release agent particles is performed in order to form aggregated particles including the resin particles, the colorant particles, and the release agent particles, the aggregated particles having a diameter close to that of the desired toner particles.

Specifically, for example, a flocculant is added to the mixed dispersion liquid, and the pH of the mixed dispersion liquid is controlled to be acidic (e.g., pH of 2 or more and 5 or less). A dispersion stabilizer may be added to the mixed dispersion liquid as needed. Subsequently, the mixed dispersion liquid is heated to a temperature close to the glass transition temperature of the resin particles (specifically, e.g., [glass transition temperature of the resin particles—30° C.] or more and [the glass transition temperature—10° C.] or less), and thereby the particles dispersed in the mixed dispersion liquid are caused to aggregate together to form aggregated particles.

In the aggregated particle formation step, alternatively, for example, the above flocculant may be added to the mixed dispersion liquid at room temperature (e.g., 25° C.) while the mixed dispersion liquid is stirred using a rotary-shearing homogenizer. Then, the pH of the mixed dispersion liquid is controlled to be acidic (e.g., pH of 2 or more and 5 or less), and a dispersion stabilizer may be added to the mixed dispersion liquid as needed. Subsequently, the mixed dispersion liquid is heated in the above-described manner.

Examples of the flocculant include surfactants, inorganic metal salts, and divalent or higher metal complexes that have a polarity opposite to that of the surfactant included in the mixed dispersion liquid. Using a metal complex as a flocculant reduces the amount of surfactant used and, as a result, charging characteristics may be enhanced.

An additive capable of forming a complex or a bond similar to a complex with the metal ions contained in the flocculant may optionally be used in combination with the flocculant. An example of the additive is a chelating agent.

Examples of the inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of such a chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the flocculant used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion liquid in which the aggregated particles are dispersed is heated to, for example, a temperature that is higher than the glass transition temperature of the resin particles (e.g., a temperature higher than the glass transition temperature of the resin particles by 30° C. to 50° C.) and is higher than the melting temperature of the release agent in order to perform fusion and coalescence of the aggregated particles. Hereby, toner particles are prepared.

In the fusion-coalescence step, the resin and the release agent are in a molten state when the temperature is equal to or higher than either the glass transition temperature of the resin particles or the melting temperature of the release agent. Subsequently, cooling is performed to produce a toner.

The aspect ratio of the release agent included in the toner may be adjusted by, for example, performing holding at a temperature around the freezing point of the release agent for a certain period of time during cooling in order to cause crystal growth or by using two or more types of release agents having different melting temperatures in order to promote crystal growth during cooling.

The toner particles are prepared through the above-described steps.

It is also possible to prepare the toner particles by, after preparing the aggregated particle dispersion liquid in which the aggregated particles are dispersed, further mixing the aggregated particle dispersion liquid with a resin particle dispersion liquid in which resin particles are dispersed and subsequently performing aggregation such that the release agent particles and the resin particles are deposited on the surfaces of the aggregated particles in order to form second aggregated particles; and by heating the resulting second-aggregated particle dispersion liquid in which the second aggregated particles are dispersed and thereby causing fusion and coalescence of the second aggregated particles to occur in order to form toner particles having a core-shell structure.

After the completion of the fusion-coalescence step, the toner particles formed in the solution are subjected to any suitable cleaning step, solid-liquid separation step, and drying step that are known in the related art in order to obtain dried toner particles. In the cleaning step, the toner particles may be subjected to displacement washing using ion-exchange water to a sufficient degree from the viewpoint of electrification characteristics. Examples of a solid-liquid separation method used in the solid-liquid separation step include suction filtration and pressure filtration from the viewpoint of productivity. Examples of a drying method used in the drying step include freeze-drying, flash drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a HENSCHEL mixer, a Lodige mixer, or the like. Optionally, coarse toner particles may be removed using a vibrating screen classifier, a wind screen classifier, or the like.

Electrostatic Image Developer

An electrostatic image developer according to the exemplary embodiment includes at least the toner according to the exemplary embodiment. The electrostatic image developer according to the exemplary embodiment may be a single component developer including only the toner according to the exemplary embodiment or may be a two-component developer that is a mixture of the toner and a carrier.

The type of the carrier is not limited, and any suitable carrier known in the related art may be used. Examples of the carrier include a coated carrier prepared by coating the surfaces of cores including magnetic powder particles with a resin; a magnetic-powder-dispersed carrier prepared by dispersing and mixing magnetic powder particles in a matrix resin; and a resin-impregnated carrier prepared by impregnating a porous magnetic powder with a resin. The magnetic-powder-dispersed carrier and the resin-impregnated carrier may also be prepared by coating the surfaces of particles constituting the carrier, that is, core particles, with a resin.

Examples of the magnetic powder include powders of magnetic metals, such as iron, nickel, and cobalt; and powders of magnetic oxides, such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin. The coat resin and the matrix resin may optionally include additives, such as conductive particles. Examples of the conductive particles include particles of metals, such as gold, silver, and copper; and particles of carbon black, titanium oxide, zinc oxide, tin oxide, barium sulfate, aluminum borate, and potassium titanate.

The surfaces of the cores can be coated with a resin by, for example, using a coating-layer forming solution prepared by dissolving the coat resin and, as needed, various types of additives in a suitable solvent. The type of the solvent is not limited and may be selected with consideration of the type of the resin used, ease of applying the coating-layer forming solution, and the like. Specific examples of a method for coating the surfaces of the cores with the coat resin include an immersion method in which the cores are immersed in the coating-layer forming solution; a spray method in which the coating-layer forming solution is sprayed onto the surfaces of the cores; a fluidized-bed method in which the coating-layer forming solution is sprayed onto the surfaces of the cores while the cores are floated using flowing air; and a kneader-coater method in which the cores of the carrier are mixed with the coating-layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

Image Forming Apparatus and Image Forming Method

An image forming apparatus and an image forming method according to the exemplary embodiment are described below.

The image forming apparatus according to the exemplary embodiment includes an image holding member; a charging unit that charges the surface of the image holding member; an electrostatic image formation unit that forms an electrostatic image on the charged surface of the image holding member; a developing unit that includes an electrostatic image developer and develops the electrostatic image formed on the surface of the image holding member with the electrostatic image developer to form a toner image; a transfer unit that transfers the toner image formed on the surface of the image holding member onto the surface of a recording medium; and a fixing unit that fixes the toner image onto the surface of the recording medium. The electrostatic image developer is the electrostatic image developer according to the exemplary embodiment.

The image forming apparatus according to the exemplary embodiment uses an image forming method (image forming method according to the exemplary embodiment) including charging the surface of the image holding member; forming an electrostatic image on the charged surface of the image holding member; developing the electrostatic image formed on the surface of the image holding member with the electrostatic image developer according to the exemplary embodiment to form a toner image; transferring the toner image formed on the surface of the image holding member onto the surface of a recording medium; and fixing the toner image onto the surface of the recording medium.

The image forming apparatus according to the exemplary embodiment may be any image forming apparatus known in the related art, such as a direct-transfer image forming apparatus in which a toner image formed on the surface of an image holding member is directly transferred to a recording medium; an intermediate-transfer image forming apparatus in which a toner image formed on the surface of an image holding member is transferred onto the surface of an intermediate transfer body in the first transfer step and the toner image transferred on the surface of the intermediate transfer body is transferred onto the surface of a recording medium in the second transfer step; an image forming apparatus including a cleaning unit that cleans the surface of the image holding member subsequent to the transfer of the toner image before the image holding member is again charged; and an image forming apparatus including a static-erasing unit that erases static by irradiating the surface of an image holding member with static-erasing light subsequent to the transfer of the toner image before the image holding member is again charged.

In the case where the image forming apparatus according to the exemplary embodiment is the intermediate-transfer image forming apparatus, the transfer unit may be constituted by, for example, an intermediate transfer body to which a toner image is transferred, a first transfer subunit that transfers a toner image formed on the surface of the image holding member onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attachable to the image forming apparatus. An example of the process cartridge is a process cartridge including the electrostatic image developer according to the exemplary embodiment and the developing unit.

An example of the image forming apparatus according to the exemplary embodiment is described below, but the image forming apparatus is not limited thereto. Hereinafter, only components illustrated in drawings are described; others are omitted.

FIG. 1 schematically illustrates the image forming apparatus according to the exemplary embodiment.

The image forming apparatus illustrated in FIG. 1 includes first to fourth electrophotographic image formation units 10Y, 10M, 10C, and 10K that form yellow (Y), magenta (M), cyan (C), and black (K) images, respectively, on the basis of color separation image data. The image formation units (hereinafter, referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24, which are arranged to contact with the inner surface of the intermediate transfer belt 20, and runs clockwise in FIG. 1, that is, in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer belt-cleaning device 30 is disposed so as to contact with the image holding member-side surface of the intermediate transfer belt 20 and to face the drive roller 22.

Developing devices (examples of the developing units) 4Y, 4M, 4C, and 4K of the units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure and the same action, the following description is made with reference to, as a representative, the first unit 10Y that forms an yellow image and is located upstream in a direction in which the intermediate transfer belt runs.

The first unit 10Y includes a photosensitive member 1Y serving as an image holding member. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic image formation unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller 5Y (example of the first transfer subunit) that transfers the developed toner image to the intermediate transfer belt 20; and a photosensitive-member cleaning device (example of the image holding member-cleaning unit) 6Y that removes a toner remaining on the surface of the photosensitive member 1Y after the first transfer.

The first transfer roller 5Y is disposed so as to contact with the inner surface of the intermediate transfer belt 20 and to face the photosensitive member 1Y. Each of the first transfer rollers 5Y, 5M, 5C, and 5K of the respective units is connected to a bias power supply (not illustrated) that applies a first transfer bias to the first transfer rollers. Each bias power supply varies the transfer bias applied to the corresponding first transfer roller on the basis of the control by a controller (not illustrated).

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}$ Ωcm or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the surface of the charged photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the erased latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated). The toner particles remaining on the photosensitive member 1Y are removed by the photosensitive-member cleaning device 6Y and then collected.

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The resulting intermediate transfer belt 20 on which toner images of four colors are multiple-transferred in the first to fourth units is then transported to a second transfer section including a support roller 24 contacting with the inner surface of the intermediate transfer belt 20 and a second transfer roller (example of the second transfer subunit) 26 disposed on the image-carrier-side of the intermediate transfer belt 20. A recording paper (example of the recording medium) P is fed by a feed mechanism into a narrow space between the second transfer roller 26 and the intermediate transfer belt 20 that contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

The recording paper P on which the toner image has been transferred is transported into a nip part of the fixing device (example of the fixing unit) 28 at which a pair of fixing rollers contact with each other. The toner image is fixed to the recording paper P to form a fixed image. The recording paper P, to which the color image has been fixed, is transported toward an exit portion. Thus, the series of the steps for forming a color image are terminated.

Examples of the recording paper P to which a toner image is transferred include plain paper used in electrophotographic copiers, printers, and the like. Instead of the recording paper P, OHP films and the like may be used as a recording medium.

The surface of the recording paper P may be smooth in order to enhance the smoothness of the surface of the fixed image. Examples of such a recording paper include coated paper produced by coating the surface of plain paper with resin or the like and art paper for printing.

Process Cartridge and Toner Cartridge

A process cartridge according to the exemplary embodiment includes a developing unit that includes the electrostatic image developer according to the exemplary embodiment and develops an electrostatic image formed on the surface of an image holding member with the electrostatic image developer to form a toner image. The process cartridge according to the exemplary embodiment is detachably attachable to an image forming apparatus.

The process cartridge according to the exemplary embodiment may further include, in addition to the developing unit, at least one unit selected from an image holding member, a charging unit, an electrostatic image formation unit, a transfer unit, etc.

An example of the process cartridge according to the exemplary embodiment is described below, but the process cartridge is not limited thereto. Hereinafter, only components illustrated in FIG. 2 are described; others are omitted.

Figure 2:
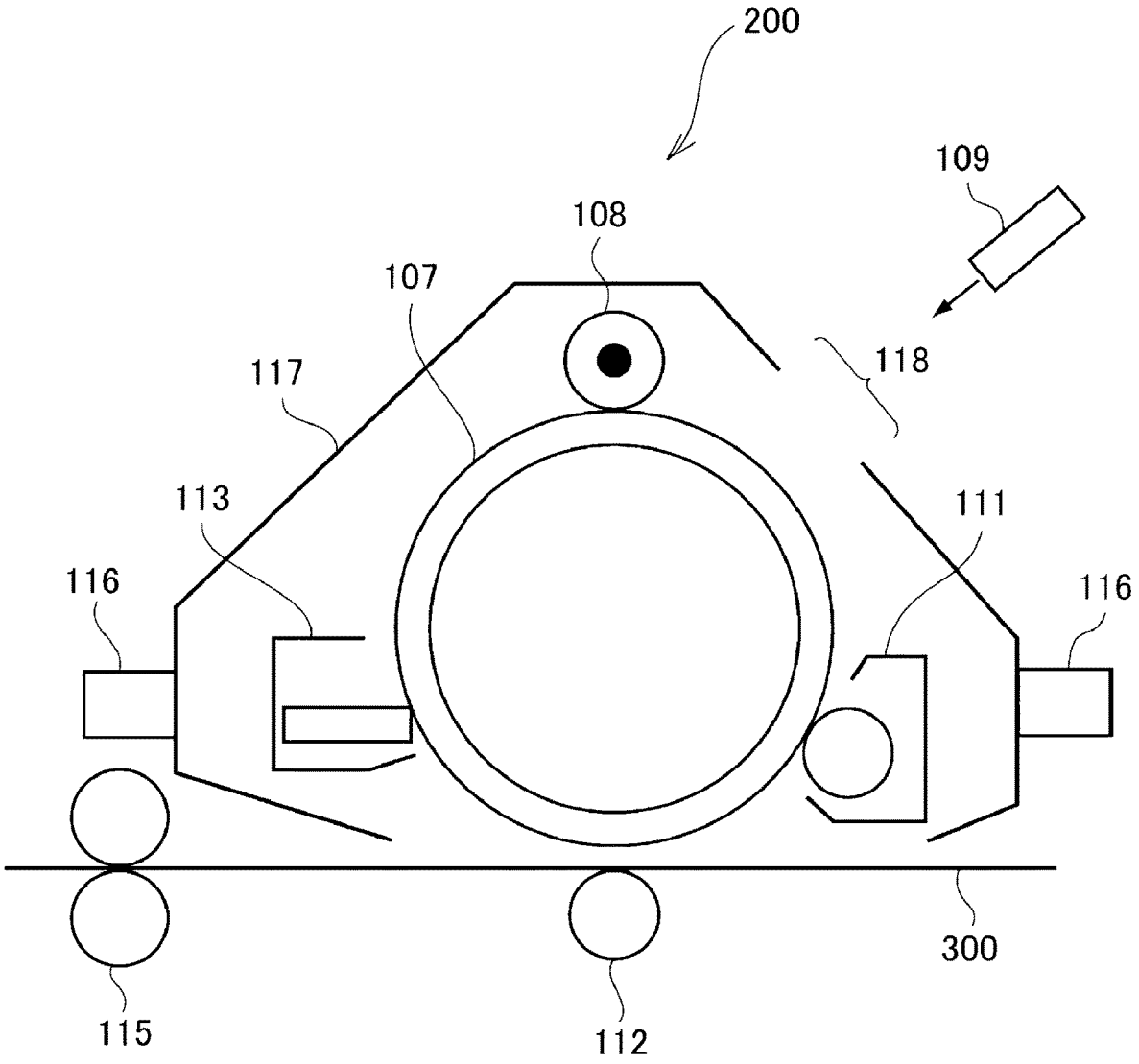
FIG. 2 is a schematic diagram illustrating a process cartridge according to an exemplary embodiment.

FIG. 2 schematically illustrates an example of the process cartridge according to the exemplary embodiment.

A process cartridge 200 illustrated in FIG. 2 includes, for example, a photosensitive member 107 (example of the image holding member), a charging roller 108 (example of the charging unit) disposed on the periphery of the photosensitive member 107, a developing device 111 (example of the developing unit), and a photosensitive-member cleaning device 113 (example of the cleaning unit), which are combined into one unit using a housing 117 to form a cartridge. The housing 117 has an aperture 118 for exposure. A mounting rail 116 is disposed on the housing 117.

In FIG. 2, Reference numeral 109 denotes an exposure device (example of the electrostatic image formation unit), Reference numeral 112 denotes a transfer device (example of the transfer unit), Reference numeral 115 denotes a fixing device (example of the fixing unit), and the Reference numeral 300 denotes recording paper (example of the recording medium).

A toner cartridge according to the exemplary embodiment is described below.

The toner cartridge according to the exemplary embodiment includes the toner according to the exemplary embodiment and is detachably attachable to an image forming apparatus. The toner cartridge includes a replenishment toner that is to be supplied to the developing unit disposed inside an image forming apparatus.

The image forming apparatus illustrated in FIG. 1 is an image forming apparatus that includes the toner cartridges 8Y, 8M, 8C, and 8K detachably attached to the image forming apparatus. Each of the developing devices 4Y, 4M, 4C, and 4K is connected to a specific one of the toner cartridges which corresponds to the color of the developing device with a toner supply pipe (not illustrated). When the amount of toner contained in a toner cartridge is small, the toner cartridge is replaced.

EXAMPLES

Examples of the present disclosure are described below. The present disclosure is not limited to Examples below. Hereinafter, the terms "part" and "%" are on a mass basis unless otherwise specified.

In Examples, the coverages of toner particles with the external additives A and B, the average circularities of the external additives A and B, and the proportion of the release agent present in a region extending from the surfaces of the toner particles to a distance of 0.8 μm from the surfaces of the toner particles are measured by the above-described methods.

Preparation of Resin Particle Dispersion Liquid 1

Ethylene glycol (produced by Wako Pure Chemical Industries, Ltd.): 37 parts by mass Neopentyl glycol (produced by Wako Pure Chemical Industries, Ltd.): 65 parts by mass 1,9-Nonanediol (produced by Wako Pure Chemical Industries, Ltd.): 32 parts by mass Terephthalic acid (produced by Wako Pure Chemical Industries, Ltd.): 96 parts by mass The above components are charged into a flask and heated to 200° C. over 1 hour. After it has been confirmed that the inside of the reaction system has been uniformly stirred, 1.2 parts by mass of dibutyltin oxide is charged into the flask. While the product water is removed by distillation, the temperature is increased from 200° C. to 240° C. over 6 hours. Then, the dehydration condensation reaction is continued for another 4 hours at 240° C. Hereby, a polyester resin having an acid value of 9.4 mgKOH/g, a weight average molecular weight of 13,000, and a glass transition temperature of 62° C. is prepared.

While the polyester resin is in a molten state, the polyester resin is transferred to "CAVITRON CD1010" produced by EUROTEC at a rate of 100 g/min. A 0.37 mass %-dilute ammonia water prepared by diluting reagent ammonia water with ion-exchange water is charged into another aqueous medium tank and transferred to the CAVITRON at a rate of 0.1 L/min as well as the molten polyester resin while being heated to 120° C. with a heat exchanger. The CAVITRON is operated with a rotor rotation speed of 60 Hz and a pressure of 5 kg/cm$^2$. Hereby, a resin particle dispersion liquid having an average particle size of 160 nm, a solid content of 30%, a glass transition temperature of 62° C., and a weight average molecular weight Mw of 13,000 is prepared (resin particle dispersion liquid 1).

Preparation of Colorant Particle Dispersion Liquid

Yellow pigment "Hansa Yellow 5GX 01" produced by Clariant: 10 parts by mass

Anionic surfactant "NEOGEN SC" produced by Dai-ichi Kogyo Seiyaku Co., Ltd.: 2 parts by mass Ion-exchange water: 80 parts by mass The above components are mixed with one another, and the resulting mixture is dispersed with a high-pressure impact disperser "Ultimaizer HJP30006" produced by Sugino Machine Limited for 1 hour. Hereby, a colorant particle dispersion liquid having a volume average particle size of 180 nm and a solid content of 20% is prepared.

Synthesis of Binder Resin 1

Decanedioic acid, produced by Tokyo Chemical Industry Co., Ltd.: 81 parts by mass Hexanediol, produced by Wako Pure Chemical Industries, Ltd.: 47 parts by mass The above components are charged into a flask and heated to 160° C. over 1 hour. After it has been confirmed that the inside of the reaction system has been uniformly stirred, 0.03 parts by mass of dibutyltin oxide is charged into the flask. While the product water is removed by distillation, the temperature is increased from 160° C. to 200° C. over 6 hours. Then, the dehydration condensation reaction is continued for another 4 hours at 200° C. Subsequently, the reaction is terminated. The reaction solution is cooled and solid-liquid separation is subsequently performed. The resulting solid substance is dried at 40° C. in vacuum. Hereby, a binder resin 1 is prepared.

The melting point of the binder resin 1 measured with a differential scanning calorimeter "DSC-7" produced by PerkinElmer, Inc. is 64° C. The weight average molecular weight of the binder resin 1 measured with a molecular weight analyzer "HLC-8020" produced by Tosoh Corporation using a tetrahydrofuran (THF) as a solvent is 15,000.

Preparation of Resin Particle Dispersion Liquid 2

Binder resin 1: 50 parts by mass Anionic surfactant "NEOGEN SC" produced by Dai-ichi Kogyo Seiyaku Co., Ltd.: 1.5 parts by mass Non-ionic surfactant "EMULGEN 147" produced by Kao Corporation: 0.5 parts by mass Ion-exchange water: 200 parts by mass The above components are heated to 120° C. and sufficiently dispersed with a homogenizer "ULTRA-TURRAX T50" produced by IKA. A further dispersion treatment is performed with a pressure-discharge homogenizer. The resulting dispersion liquid is recovered when the volume average particle size thereof reaches 180 nm. Hereby, a resin dispersion liquid 2 having a solid content of 20% is prepared.

Preparation of Release Agent Particle Dispersion Liquid 1

Paraffin wax "HNP-9" produced by Nippon Seiro Co., Ltd.: 50 parts by mass

Anionic surfactant "NEOGEN SC" produced by Dai-ichi Kogyo Seiyaku Co., Ltd.: 1.5 parts by mass Non-ionic surfactant "EMULGEN 147" produced by Kao Corporation: 0.5 parts by mass Ion-exchange water: 200 parts by mass The above components are mixed with one another and heated to 120° C. The resulting mixture is dispersed to a sufficient degree with a homogenizer "ULTRA-TURRAX T50" produced by IKA and then further dispersed with a pressure-discharge homogenizer. Hereby, a release agent particle dispersion liquid having a volume average particle size of 200 nm and a solid content of 20% is prepared.

Preparation of Release Agent Particle Dispersion Liquid 2

Polyethylene wax "POLYWAX 725" produced by Baker Hughes: 50 parts by mass

Anionic surfactant "NEOGEN SC" produced by Dai-ichi Kogyo Seiyaku Co., Ltd.: 1.5 parts by mass Non-ionic surfactant "EMULGEN 147" produced by Kao Corporation: 0.5 parts by mass Ion-exchange water: 200 parts by mass The above components are mixed with one another and heated to 120° C. The resulting mixture is dispersed to a sufficient degree with a homogenizer "ULTRA-TURRAX T50" produced by IKA and then further dispersed with a pressure-discharge homogenizer. Hereby, a release agent particle dispersion liquid having a volume average particle size of 200 nm and a solid content of 20% is prepared.

Preparation of Styrene Acrylate-Modified Polyester Resin Particle Dispersion Liquid (SPE1)

The inside of a four-necked flask equipped with a nitrogen introducing tube, a dewatering tube, a stirrer, and a thermocouple is purged with nitrogen. Into the flask, 5,670 parts of polyoxypropylene(2.2)-2,2-bis(4-hydroxyphenyl)propane, 585 parts of polyoxyethylene(2.0)-2,2-bis(4-hydroxyphenyl)propane, 2,450 parts of terephthalic acid, and 44 parts of tin(II) di(2-ethylhexanoate) are charged. In a nitrogen atmosphere, while the resulting mixture is stirred, the temperature is increased to 235° C. and then maintained for 5 hours. Subsequently, the pressure inside the flask is reduced and maintained at 8.0 kPa for 1 hour. After the pressure has been increased to atmospheric pressure, the temperature is reduced to 190° C. Then, 42 parts of fumaric acid and 207 parts of trimellitic acid are added to the flask. After the temperature has been maintained at 190° C. for 2 hours, the temperature is increased to 210° C. over 2 hours. The pressure inside the flask is subsequently reduced and maintained at 8.0 kPa for 4 hours. Hereby, an amorphous polyester resin A (polyester segment) is prepared.

To a four-neck flask equipped with a cooling tube, a stirring device, and a thermocouple, 800 parts of the amorphous polyester resin A is added. Then, stirring is performed at a speed of 200 rpm in a nitrogen atmosphere. Subsequently, as an addition polymerizable monomer, 40 parts of styrene, 142 parts of ethyl acrylate, 16 parts of acrylic acid, 2 parts of 1,10-decanediol diacrylate, and 1,000 parts of toluene are added to the flask. The resulting mixture is stirred for 30 minutes.

Into the flask, 6 parts of polyoxyethylene alkyl ether (non-ionic surfactant "EMULGEN 430" produced by Kao Corporation), 40 parts of a 15% aqueous sodium dodecylbenzenesulfonate solution (anionic surfactant "NEOPELEX G-15" produced by Kao Corporation), and 233 parts of 5% potassium hydroxide are charged. While the resulting mixture is stirred, the temperature is increased to 95° C. to melt the mixture. The mixture is stirred at 95° C. for 2 hours to form a resin mixture solution.

While the resin mixture solution is stirred, 1,145 parts of deionized water is added dropwise to the flask at a rate of 6 part/min to prepare an emulsion. The emulsion is cooled to 25° C. and passed through a 200-mesh screen. Deionized water is added to the filtrate such that the solid content of the resulting dispersion liquid is 30%. Hereby, a styrene acrylate-modified polyester resin particle dispersion liquid (SPE1) is prepared.

The amount of the constitutional unit derived from styrene included in the synthesized styrene acrylate-modified polyester resin is 4% by mass of the total mass of the styrene acrylate-modified polyester resin.

Preparation of Styrene Acrylate-Modified Polyester Resin Particle Dispersion Liquid (SPE2)

The inside of a four-necked flask equipped with a nitrogen introducing tube, a dewatering tube, a stirrer, and a thermocouple is purged with nitrogen. Into the flask, 5,670 parts of polyoxypropylene(2.2)-2,2-bis(4-hydroxyphenyl)propane, 585 parts of polyoxyethylene(2.0)-2,2-bis(4-hydroxyphenyl)propane, 2,450 parts of terephthalic acid, and 44 parts of tin(II) di(2-ethylhexanoate) are charged. In a nitrogen atmosphere, while the resulting mixture is stirred, the temperature is increased to 235° C. and then maintained for 5 hours. Subsequently, the pressure inside the flask is reduced and maintained at 8.0 kPa for 1 hour. After the pressure has been increased to atmospheric pressure, the temperature is reduced to 190° C. Then, 42 parts of fumaric acid and 207 parts of trimellitic acid are added to the flask. After the temperature has been maintained at 190° C. for 2 hours, the temperature is increased to 210° C. over 2 hours. The pressure inside the flask is subsequently reduced and maintained at 8.0 kPa for 4 hours. Hereby, an amorphous polyester resin A (polyester segment) is prepared.

To a four-neck flask equipped with a cooling tube, a stirring device, and a thermocouple, 800 parts of the amorphous polyester resin A is added. Then, stirring is performed at a speed of 200 rpm in a nitrogen atmosphere. Subsequently, as an addition polymerizable monomer, 60 parts of styrene, 122 parts of ethyl acrylate, 16 parts of acrylic acid, 2 parts of 1,10-decanediol diacrylate, and 1,000 parts of toluene are added to the flask. The resulting mixture is stirred for 30 minutes.

Into the flask, 6 parts of polyoxyethylene alkyl ether (non-ionic surfactant "EMULGEN 430" produced by Kao Corporation), 40 parts of a 15% aqueous sodium dodecylbenzenesulfonate solution (anionic surfactant "NEOPELEX G-15" produced by Kao Corporation), and 233 parts of 5% potassium hydroxide are charged. While the resulting mixture is stirred, the temperature is increased to 95° C. to melt the mixture. The mixture is stirred at 95° C. for 2 hours to form a resin mixture solution.

While the resin mixture solution is stirred, 1,145 parts of deionized water is added dropwise to the flask at a rate of 6 part/min to prepare an emulsion. The emulsion is cooled to 25° C. and passed through a 200-mesh screen. Deionized water is added to the filtrate such that the solid content of the resulting dispersion liquid is 30%. Hereby, a styrene acrylate-modified polyester resin particle dispersion liquid (SPE2) is prepared.

The amount of the constitutional unit derived from styrene included in the synthesized styrene acrylate-modified polyester resin is 6% by mass of the total mass of the styrene acrylate-modified polyester resin.

Preparation of Styrene Acrylate-Modified Polyester Resin Particle Dispersion Liquid (SPE3)

The inside of a four-necked flask equipped with a nitrogen introducing tube, a dewatering tube, a stirrer, and a thermocouple is purged with nitrogen. Into the flask, 5,670 parts of polyoxypropylene(2.2)-2,2-bis(4-hydroxyphenyl)propane, 585 parts of polyoxyethylene(2.0)-2,2-bis(4-hydroxyphenyl)propane, 2,450 parts of terephthalic acid, and 44 parts of tin(II) di(2-ethylhexanoate) are charged. In a nitrogen atmosphere, while the resulting mixture is stirred, the temperature is increased to 235° C. and then maintained for 5 hours. Subsequently, the pressure inside the flask is reduced and maintained at 8.0 kPa for 1 hour. After the pressure has been increased to atmospheric pressure, the temperature is reduced to 190° C. Then, 42 parts of fumaric acid and 207 parts of trimellitic acid are added to the flask. After the temperature has been maintained at 190° C. for 2 hours, the temperature is increased to 210° C. over 2 hours. The pressure inside the flask is subsequently reduced and maintained at 8.0 kPa for 4 hours. Hereby, an amorphous polyester resin A (polyester segment) is prepared.

To a four-neck flask equipped with a cooling tube, a stirring device, and a thermocouple, 800 parts of the amorphous polyester resin A is added. Then, stirring is performed at a speed of 200 rpm in a nitrogen atmosphere. Subsequently, as an addition polymerizable monomer, 150 parts of styrene, 32 parts of ethyl acrylate, 16 parts of acrylic acid, 2 parts of 1,10-decanediol diacrylate, and 1,000 parts of toluene are added to the flask. The resulting mixture is stirred for 30 minutes.

Into the flask, 6 parts of polyoxyethylene alkyl ether (non-ionic surfactant "EMULGEN 430" produced by Kao Corporation), 40 parts of a 15% aqueous sodium dodecylbenzenesulfonate solution (anionic surfactant "NEOPELEX G-15" produced by Kao Corporation), and 233 parts of 5% potassium hydroxide are charged. While the resulting mixture is stirred, the temperature is increased to 95° C. to melt the mixture. The mixture is stirred at 95° C. for 2 hours to form a resin mixture solution.

While the resin mixture solution is stirred, 1,145 parts of deionized water is added dropwise to the flask at a rate of 6 part/min to prepare an emulsion. The emulsion is cooled to 25° C. and passed through a 200-mesh screen. Deionized water is added to the filtrate such that the solid content of the resulting dispersion liquid is 30%. Hereby, a styrene acrylate-modified polyester resin particle dispersion liquid (SPE3) is prepared.

The amount of the constitutional unit derived from styrene included in the synthesized styrene acrylate-modified polyester resin is 15% by mass of the total mass of the styrene acrylate-modified polyester resin.

Preparation of Styrene Acrylate-Modified Polyester Resin Particle Dispersion Liquid (SPE4)

The inside of a four-necked flask equipped with a nitrogen introducing tube, a dewatering tube, a stirrer, and a thermocouple is purged with nitrogen. Into the flask, 5,670 parts of polyoxypropylene(2.2)-2,2-bis(4-hydroxyphenyl)propane, 585 parts of polyoxyethylene(2.0)-2,2-bis(4-hydroxyphenyl)propane, 2,450 parts of terephthalic acid, and 44 parts of tin(II) di(2-ethylhexanoate) are charged. In a nitrogen atmosphere, while the resulting mixture is stirred, the temperature is increased to 235° C. and then maintained for 5 hours. Subsequently, the pressure inside the flask is reduced and maintained at 8.0 kPa for 1 hour. After the pressure has been increased to atmospheric pressure, the temperature is reduced to 190° C. Then, 42 parts of fumaric acid and 207 parts of trimellitic acid are added to the flask. After the temperature has been maintained at 190° C. for 2 hours, the temperature is increased to 210° C. over 2 hours. The pressure inside the flask is subsequently reduced and maintained at 8.0 kPa for 4 hours. Hereby, an amorphous polyester resin A (polyester segment) is prepared.

To a four-neck flask equipped with a cooling tube, a stirring device, and a thermocouple, 800 parts of the amorphous polyester resin A is added. Then, stirring is performed at a speed of 200 rpm in a nitrogen atmosphere. Subsequently, as an addition polymerizable monomer, 170 parts of styrene, 12 parts of ethyl acrylate, 16 parts of acrylic acid, 2 parts of 1,10-decanediol diacrylate, and 1,000 parts of toluene are added to the flask. The resulting mixture is stirred for 30 minutes.

Into the flask, 6 parts of polyoxyethylene alkyl ether (non-ionic surfactant "EMULGEN 430" produced by Kao Corporation), 40 parts of a 15% aqueous sodium dodecylbenzenesulfonate solution (anionic surfactant "NEOPELEX G-15" produced by Kao Corporation), and 233 parts of 5% potassium hydroxide are charged. While the resulting mixture is stirred, the temperature is increased to 95° C. to melt the mixture. The mixture is stirred at 95° C. for 2 hours to form a resin mixture solution.

While the resin mixture solution is stirred, 1,145 parts of deionized water is added dropwise to the flask at a rate of 6 part/min to prepare an emulsion. The emulsion is cooled to 25° C. and passed through a 200-mesh screen. Deionized water is added to the filtrate such that the solid content of the resulting dispersion liquid is 30%. Hereby, a styrene acrylate-modified polyester resin particle dispersion liquid (SPE4) is prepared.

The amount of the constitutional unit derived from styrene included in the synthesized styrene acrylate-modified polyester resin is 17% by mass of the total mass of the styrene acrylate-modified polyester resin.

Preparation of Polyester Modified Styrene Acrylate Resin Particle Dispersion Liquid (SPE5)

To a four-neck flask equipped with a cooling tube, a stirring device, and a thermocouple, 1,000 parts of butyl acetate is added. While stirring is performed, the temperature is increased to 110° C. A liquid mixture of 200 parts of styrene, 730 parts of butyl acrylate, 10 parts of 1,10-decanediol diacrylate, 60 parts of acrylic acid, and 6 parts of azobisisobutyronitrile is added dropwise to the four-neck flask over 2 hours while stirring is performed in the flask. Subsequently, while stirring is performed for another 4 hours, the temperature is maintained at 110° C. Then, the temperature is reduced to room temperature. Hereby, a styrene acrylate resin A (styrene acrylate segment) is prepared.

The inside of a four-necked flask equipped with a nitrogen introducing tube, a dewatering tube, a stirrer, and a thermocouple is purged with nitrogen. Into the flask, 138 parts of polyoxypropylene(2.2)-2,2-bis(4-hydroxyphenyl)propane, 32 parts of polyoxyethylene(2.0)-2,2-bis(4-hydroxyphenyl) propane, 88 parts of terephthalic acid, and 1 part of tin(II) di(2-ethylhexanoate) are charged. In a nitrogen atmosphere, while the resulting mixture is stirred, the temperature is increased to 235° C. and then maintained for 5 hours. Subsequently, the pressure inside the flask is reduced and maintained at 8.0 kPa for 5 hours.

Into the flask, 3 parts of polyoxyethylene alkyl ether (non-ionic surfactant "EMULGEN 430" produced by Kao Corporation), 20 parts of a 15% aqueous sodium dodecylbenzenesulfonate solution (anionic surfactant "NEOPELEX G-15" produced by Kao Corporation), and 116 parts of 5% potassium hydroxide are charged. While the resulting mixture is stirred, the temperature is increased to 95° C. to melt the mixture. The mixture is stirred at 95° C. for 2 hours to form a resin mixture solution.

While the resin mixture solution is stirred, 1,000 parts of deionized water is added dropwise to the flask at a rate of 6 part/min to prepare an emulsion. The emulsion is cooled to 25° C. and passed through a 200-mesh screen. Deionized water is added to the filtrate such that the solid content of the resulting dispersion liquid is 30%. Hereby, a polyester-modified styrene acrylate resin particle dispersion liquid (SPES) is prepared.

The amount of the constitutional unit derived from styrene included in the synthesized polyester-modified styrene acrylate resin is 150% by mass of the total mass of the polyester-modified styrene acrylate resin.

Preparation of Sol Gel Silica Particles ZG1

Silica Particle Formation Step

Into a glass reaction container equipped with a stirrer, a dropping nozzle, and a thermometer, 300 parts of methanol and 90 parts of 10% ammonia water are charged. The above materials are mixed with each other to form an alkali catalyst solution. After the temperature of the alkali catalyst solution has been adjusted to be 20° C., 90 parts of tetramethoxysilane (TMOS) and 1.7 parts of 10% ammonia water are added dropwise to the reaction container while the alkali catalyst solution is stirred. Hereby, a silica particle dispersion liquid is prepared. The addition of the TMOS and the addition of the 10% ammonia water are started at the same time. It takes 3 minutes to add the whole amounts of the TMOS and the 10% ammonia water dropwise to the reaction container. The silica particle dispersion liquid is concentrated using a rotary filter "R-FINE" produced by Kotobuki Industries Co., Ltd. until the concentration of the solid component reaches 40% by mass. The concentrated silica particle dispersion liquid is used as a silica particle dispersion liquid (1).

Silica Particle Surface Treatment Step

To 250 parts of the silica particle dispersion liquid (1), 100 parts of hexamethyldisilazane (HMDS) that serves as a hydrophobizing agent is added. After the resulting mixture has been heated to 130° C. to react for 2 hours, drying is performed at 150° C. for 2 minutes. Hereby, hydrophobic silica particles (1) are prepared. Subsequently, tetrakis(trimethylsiloxy)silane is prepared in an amount that is 0.020% by mass of the amount of the silica particle dispersion liquid (1). The tetrakis(trimethylsiloxy)silane is diluted 5 times with methanol and then added to the hydrophobic silica particles (1). Subsequently, drying is performed while the inside of the reaction system is stirred at 80° C. Hereby, sol gel silica particles ZG1 are prepared. The number average size of the sol gel silica particles ZG1 is 80 nm. The content of a siloxane compound in the sol gel silica particles ZG1 is 13 ppm.

Example 1

Preparation of Toner 1

Resin particle dispersion liquid 1: 150 parts by mass

Colorant particle dispersion liquid: 25 parts by mass

Release agent particle dispersion liquid 1: 35 parts by mass

Resin particle dispersion liquid 2: 50 parts by mass

Polyaluminum chloride: 0.4 parts by mass

Ion-exchange water: 100 parts by mass

The above components are charged into a round stainless steel flask and mixed and dispersed to a sufficient degree using an ULTRA-TURRAX T50 produced by IKA. Subsequently, the flask is heated to 48° C. while the contents of the flask are stirred in an oil bath for heating. Subsequently, the flask is maintained for 60 minutes. Hereby, aggregated particles that serve as cores are prepared. Then, 100 parts by mass of the resin particle dispersion liquid 1 is gradually added to the flask to form shells. After the pH of the system has been adjusted to be 8.0 using an aqueous sodium hydroxide solution having a concentration of 0.5 mol/L, the stainless steel flask is hermetically sealed and the stirrer shaft is magnetically sealed. While stirring is continued, the flask is heated to 90° C. and held for 30 minutes. Subsequent to the termination of the reaction, cooling is performed at a cooling rate of 5° C./min. Subsequent to filtration and sufficient cleaning with ion-exchange water, solid-liquid separation is performed by Nutsche suction filtration. The resulting component is again dispersed in 3,000 parts by mass of ion-exchange water having a temperature of 30° C. The resulting dispersion liquid is stirred at a rotation speed of 300 rpm for 15 minutes in order to perform cleaning. This cleaning operation is further performed six times. When the pH of the filtrate reaches 7.54 and the electrical conductivity of the filtrate reaches 6.5 μS/cm, solid-liquid separation is performed by Nutsche suction filtration using a No. 5A filter paper. The resulting component is vacuum-dried for 24 hours to form a toner.

The volume average particle size $D_{50v}$ of the toner measured with a Coulter counter is 5.7 μm.

External Additive Containing Toner 1

To a sample mill, 60 parts of the toner 1 and 3.0 parts of the sol gel silica particles ZG1 are added. The resulting mixture is stirred in the sample mill at 10,000 rpm (revolutions per minute) for 30 seconds. Subsequently, 0.7 parts of "RY50" produced by Nippon Aerosil Co., Ltd. having a number average particle size of 140 nm is added to the sample mill. After the temperature of the sample mill has been adjusted to be 20° C., stirring is performed at 16,000 rpm for 50 seconds. Hereby, an external additive containing toner 1 is prepared.

Preparation of Electrostatic Image Developer

With 8 parts by mass of the external additive containing toner 1, 100 parts by mass of resin-coated ferrite carrier particles (average particle size: 35 μm) are mixed to prepare a two-component developer. Hereby, a developer (electrostatic image developer) is prepared. The developer is charged into a developing device of "DocuPrint C2220" produced by Fuji Xerox Co., Ltd. and then seasoned for 24 hours in a low temperature, low humidity environment (10° C. and 15% RH).

Examples 2 to 18 and Comparative Examples 1 to 3

In Examples 2 to 18 and Comparative examples 1 to 3, a toner is prepared as in Example 1, except that the resin particle dispersion liquid and the release agent particle dispersion liquid described in Table 1 are used, and an electrostatic image developer is prepared using the toner as in Example 1, except that the external additive described in Table 1 is used.

In Examples 2 to 18 and Comparative examples 2 and 3, the external additive containing toner is prepared by mixing 60 parts of the toner with a specific amount of the external additive A as described in Table 1, stirring the resulting mixture in a sample mill at 10,000 rpm for 30 seconds, further adding a specific amount of the external additive B to the sample mill as described in Table 1, and after adjusting the temperature of the sample mill to be 42° C., performing stirring at 16,000 rpm for 50 seconds.

In Comparative example 1, the external additive containing toner is prepared by mixing 60 parts of the toner, 1.7 parts of the sol gel silica particles ZG1, and 1.2 parts of RY50 with one another and, after adjusting the temperature of a sample mill to be 42° C., performing stirring at 16,000 rpm for 50 seconds.

Evaluation of Reduction in Inconsistencies in Gloss

A specific one of the developers is charged into the developing device of "Color 1000i Press" produced by Fuji Xerox Co., Ltd. A solid image is formed on a sheet of "SP Paper" produced by Fuji Xerox Co., Ltd. (thickness: 81 μm, basis weight: 60 g/m$^2$), which has been stored at 28° C. and a humidity of 85% RH for 24 hours, with a fusing temperature of 180° C. (pressure roller temperature: 100° C.) such that the deposition density of a silver toner (a toner for "Color 1000i Press" produced by Fuji Xerox Co., Ltd.) is 4.0 g/m$^2$ and the deposition density of the yellow toner (the toner prepared in Examples) is 4.0 g/m$^2$.

The gloss of the solid image is measured with a gloss meter "GM-26D" produced by Murakami Color Research Laboratory Co., Ltd. such that the angle of the light incident on the image is 75 degrees. The gloss of the solid image is measured at 9 positions at which 3 lines arranged parallel to the breadthwise direction of the plain paper sheet at positions 5, 15, and 25 cm from an edge of the plain paper sheet in the lengthwise direction intersect 3 lines arranged parallel to the lengthwise direction of the plain paper sheet at positions 4, 10.5, and 17 cm from an edge of the plain paper sheet in the breadthwise direction.

The standard deviation of the gloss values measured at the 9 positions is calculated. The lower the standard deviation, the smaller the inconsistencies in gloss. Specifically, in the case where the standard deviation is less than 0.3, the highest evaluation grade is given; in the case where the standard deviation is 0.3 or more and less than 0.6, the inconsistencies in gloss are negligibly small; in the case where the standard deviation is 0.6 or more and less than 1.0, the inconsistencies in gloss may be confirmed when the image is inspected in detail; in the case where the standard deviation is 1.0 or more and less than 1.5, the inconsistencies in gloss may be visually undetectable; and in the case where the standard deviation is 1.5 or more and less than 2.0, the inconsistencies in gloss may be acceptable in practice.

However, if the standard deviation is 2.0 or more, inconsistencies in the gloss of the solid image may pose problems.

A: The standard deviation is less than 0.3

B: The standard deviation is 0.3 or more and less than 0.6

C: The standard deviation is 0.6 or more and less than 1.0

D: The standard deviation is 1.0 or more and less than 1.5

E: The standard deviation is 1.5 or more and less than 2.0

F: The standard deviation is 2.0 or more

Table 1 summarizes the evaluation results.

TABLE 1

| | Toner material dispersion liquid | | | | | | | | | | | | |
|---|---|---|---|---|---|---|---|---|---|---|---|---|---|
| | Core | | | | | | Shell | | | | | | |
| | Resin particle dispersion liquid | | | | Release agent particle dispersion liquid | | Resin particle dispersion liquid | | Release agent particle dispersion liquid | | External additive A | | |
| | Type | Amount added (mass part) | Type | Amount added (mass part) | Type | Amount added (mass part) | Type | Amount added (mass part) | Type | Amount added (mass part) | Type | Shape factor SF1 | Amount added (mass part) |
| Example 1 | 1 | 160 | 2 | 50 | 1 | 35 | 1 | 100 | — | — | ZG1 | 130 | 3.0 |
| Example 2 | 1 | 160 | 2 | 50 | 1 | 35 | 1 | 100 | — | — | ZG1 | 130 | 3.0 |
| Example 3 | 1 | 160 | 2 | 50 | 1 | 35 | 1 | 100 | — | — | ZG1 | 130 | 3.0 |
| Example 4 | 1 | 160 | 2 | 50 | 1 | 35 | 1 | 100 | — | — | ZG1 | 130 | 3.0 |
| Example 5 | 1 | 160 | 2 | 50 | 1 | 35 | 1 | 100 | — | — | ZG1 | 130 | 3.0 |
| Example 6 | 1 | 160 | 2 | 50 | 1 | 35 | 1 | 100 | — | — | ZG1 | 130 | 3.4 |
| Example 1 | 1 | 160 | 2 | 50 | 1 | 35 | 1 | 100 | — | — | ZG1 | 130 | 3.4 |
| Example 8 | 1 | 178 | 2 | 50 | 1 | 17 | 1 | 82 | 1 | 18 | ZG1 | 130 | 3.0 |
| Example 9 | 1 | 178 | 2 | 50 | 1 | 17 | 1 | 82 | 1 | 18 | ZG1 | 130 | 3.4 |
| Example 10 | 1 | 178 | 2 | 50 | 1 | 17 | 1 | 82 | 2 | 18 | ZG1 | 130 | 3.0 |
| Example 11 | SPE1 | 160 | 2 | 50 | 1 | 35 | SPE1 | 100 | — | — | ZG1 | 130 | 3.0 |
| Example 12 | SPE1 | 160 | 2 | 50 | 1 | 35 | SPE1 | 100 | — | — | ZG1 | 130 | 3.0 |
| Example 13 | SPE1 | 160 | 2 | 50 | 1 | 35 | SPE1 | 100 | — | — | ZG1 | 130 | 3.4 |
| Example 14 | SPE1 | 178 | 2 | 50 | 1 | 17 | SPE1 | 82 | 1 | 18 | ZG1 | 130 | 3.0 |
| Example 15 | SPE2 | 160 | 2 | 50 | 1 | 35 | SPE2 | 100 | — | — | ZG1 | 130 | 3.0 |
| Example 16 | SPE3 | 160 | 2 | 50 | 1 | 35 | SPE3 | 100 | — | — | ZG1 | 130 | 3.0 |
| Example 17 | SPE4 | 160 | 2 | 50 | 1 | 35 | SPE4 | 100 | — | — | ZG1 | 130 | 3.0 |
| Example 18 | SPE5 | 160 | 2 | 50 | 1 | 35 | SPE5 | 100 | — | — | ZG1 | 130 | 3.0 |
| Comparative example 1 | 1 | 160 | 2 | 50 | 1 | 35 | 1 | 100 | — | — | ZG1/RY50 | 134 | 3.4/1.2 |
| Comparative example 2 | 1 | 160 | 2 | 50 | 1 | 35 | 1 | 100 | — | — | ZG1 | 130 | 3.0 |
| Comparative example 3 | 1 | 160 | 2 | 50 | 1 | 35 | 1 | 100 | — | — | RY50 | 146 | 1.2 |

| | External additive A Siloxane compound | External additive B | | | Coverage of external additive A (%) | Coverage of external additive B (%) | Coverage of external additives (%) | Content of release agent in region extending to distance of 0.8 μm from surfaces of toner particles (mass %) | Proportion of mass of styrene-derived elements to total mass of hybrid resin (mass %) | Reduction in inconsistencies in gloss |
|---|---|---|---|---|---|---|---|---|---|---|
| | | Type | Shape factor SF1 | Amount added (mass part) | | | | | | |
| Example 1 | Present | RY50 | 132 | 0.7 | 46.5 | 3.3 | 46.8 | 4.8 | — | E |
| Example 2 | Present | RY50 | 137 | 0.7 | 46.3 | 3.3 | 46.8 | 5.0 | — | D |
| Example 3 | Present | RY50 | 142 | 1.2 | 47.5 | 4.9 | 47.8 | 6.0 | — | D |
| Example 4 | Present | RY50 | 146 | 1.2 | 46.1 | 4.5 | 47.1 | 5.3 | — | B |
| Example 5 | Present | RY50 | 152 | 2.0 | 46.9 | 10.2 | 48.8 | 5.1 | — | B |
| Example 6 | Present | RY50 | 137 | 0.7 | 53.2 | 3.3 | 53.3 | 5.2 | — | C |
| Example 1 | Present | RY50 | 146 | 1.2 | 52.3 | 4.5 | 52.7 | 4.6 | — | B |
| Example 8 | Present | RY50 | 137 | 0.7 | 45.1 | 3.3 | 45.5 | 53.2 | — | C |
| Example 9 | Present | RY50 | 137 | 0.7 | 52.7 | 3.2 | 53.0 | 53.2 | — | B |
| Example 10 | Present | RY50 | 137 | 0.7 | 46.3 | 3.3 | 46.6 | 53.1 | — | C |
| Example 11 | Present | RY50 | 137 | 0.7 | 45.5 | 3.4 | 45.9 | 5.0 | 4.0 | B |
| Example 12 | Present | RY50 | 146 | 1.2 | 47.2 | 4.8 | 47.3 | 4.8 | 4.0 | A |
| Example 13 | Present | RY50 | 137 | 0.7 | 53.7 | 3.4 | 53.9 | 4.8 | 4.0 | A |
| Example 14 | Present | RY50 | 137 | 0.7 | 46.5 | 3.3 | 46.9 | 55.3 | 4.0 | A |
| Example 15 | Present | RY50 | 137 | 0.7 | 46.3 | 3.5 | 46.8 | 5.4 | 6.0 | A |
| Example 16 | Present | RY50 | 137 | 0.7 | 47.1 | 3.3 | 47.3 | 5.8 | 15.0 | A |
| Example 17 | Present | RY50 | 137 | 0.7 | 45.2 | 3.4 | 45.5 | 4.5 | 17.0 | A |
| Example 18 | Present | RY50 | 137 | 0.7 | 46.7 | 3.5 | 46.9 | 6.7 | 15.0 | A |
| Comparative example 1 | Present | — | — | — | 56.2 | — | 56.2 | 4.8 | — | F |
| Comparative example 2 | Present | RY50 | 133 | 0.5 | 46.8 | 2.0 | 46.8 | 5.1 | — | F |
| Comparative example 3 | Absent | ZG1 | 132 | 3.4 | 4.6 | 51.3 | 54.2 | 5.1 | — | F |

The results described in Table 1 confirm that the electrostatic image developing toners prepared in Examples reduced inconsistencies in the gloss of the image compared with the electrostatic image developing toners prepared in Comparative examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic image developing toner comprising:

toner particles;

an external additive A; and an external additive B, wherein at least the external additive A is deposited on surfaces of the toner particles, wherein at least the external additive B is deposited on the external additive A, wherein the external additive B includes an aggregate of two or more primary particles, wherein a coverage of the toner particles with the external additive B is 3% by area or more with respect to a total surface area of the toner particles, wherein a number average particle size of the external additive A is 20 nm to 140 nm, wherein a number average particle size of the primary particles, which in aggregate form the external additive B, is 5 nm to 90 nm, wherein the number average particle size of the of external additive B minus the number average particle size of the external additive A is 10 nm to 200 nm, wherein the external additive A includes a siloxane compound having a molecular weight of 200 or more and 600 or less and consisting of a siloxane bond and an alkyl group, wherein the external additive B has a shape factor SF1 of 135 or more.

2. The electrostatic image developing toner according to claim 1, wherein the shape factor SF1 of the external additive B is 145 or more.

3. The electrostatic image developing toner according to claim 1, wherein a coverage of the toner particles with an external additive including the external additives A and B is 50% by area or more with respect to the total surface area of the toner particles.

4. The electrostatic image developing toner according to claim 2, wherein a coverage of the toner particles with an external additive including the external additives A and B is 50% by area or more with respect to the total surface area of the toner particles.

5. The electrostatic image developing toner according to claim 2, wherein a coverage of the toner particles with an external additive including the external additives A and B is 50% by area or more with respect to the total surface area of the toner particles.

6. The electrostatic image developing toner according to claim 1, wherein a ratio $C^B/C^A$ is 0.05 or more and 0.30 or less, where $C^A$ is a coverage of the toner particles with the external additive A with respect to the total surface area of the toner particles, and $C^B$ is the coverage of the toner particles with the external additive B with respect to the total surface area of the toner particles.

7. The electrostatic image developing toner according to claim 1, wherein the external additive A has a shape factor SF1 of 145 or less.

8. The electrostatic image developing toner according to claim 1, wherein the toner particles include a release agent.

9. The electrostatic image developing toner according to claim 8, wherein 50% by mass or more of the release agent is present in a region extending from the surfaces of the toner particles to a distance of 0.8 μm from the surfaces of the toner particles.

10. The electrostatic image developing toner according to claim 8, wherein the toner particles include core-shell particles, and wherein the core-shell particles include a shell layer including the release agent.

11. The electrostatic image developing toner according to claim 1, wherein the toner particles includes a binder resin including a hybrid resin, the hybrid resin including a polyester resin segment and a styrene acrylate copolymer segment.

12. The electrostatic image developing toner according to claim 11, wherein a content of a constitutional unit derived from styrene in the hybrid resin is 5% by mass or more and 20% by mass or less of a total mass of the hybrid resin.

13. An electrostatic image developer comprising the electrostatic image developing toner according to claim 1.

14. A toner cartridge detachably attachable to an image forming apparatus, the toner cartridge comprising the electrostatic image developing toner according to claim 1.

15. A process cartridge detachably attachable to an image forming apparatus, the process cartridge comprising a developing unit that includes the electrostatic image developer according to claim 13 and develops an electrostatic image formed on a surface of an image holding member with the electrostatic image developer to form a toner image.

16. An image forming apparatus comprising:

an image holding member;

a charging unit that charges a surface of the image holding member;

an electrostatic image formation unit that forms an electrostatic image on the charged surface of the image holding member;

a developing unit that includes the electrostatic image developer according to claim 13 and develops the electrostatic image formed on the surface of the image holding member with the electrostatic image developer to form a toner image;

a transfer unit that transfers the toner image formed on the surface of the image holding member onto a surface of a recording medium; and a fixing unit that fixes the toner image transferred on the surface of the recording medium.

17. An image forming method comprising:

charging a surface of an image holding member;

forming an electrostatic image on the charged surface of the image holding member;

developing the electrostatic image formed on the surface of the image holding member with the electrostatic image developer according to claim 13 to form a toner image;

transferring the toner image formed on the surface of the image holding member onto a surface of a recording medium; and fixing the toner image transferred on the surface of the recording medium.

* * * * *